US011993936B1

(12) United States Patent
Shen

(10) Patent No.: US 11,993,936 B1
(45) Date of Patent: May 28, 2024

(54) SPLICING STEP DEVICE

(71) Applicant: Hongfang Shen, Qidong (CN)

(72) Inventor: Hongfang Shen, Qidong (CN)

( * ) Notice: Subject to any disclaimer, the term of this patent is extended or adjusted under 35 U.S.C. 154(b) by 0 days.

(21) Appl. No.: 18/506,143

(22) Filed: Nov. 10, 2023

Related U.S. Application Data

(63) Continuation-in-part of application No. 29/902,133, filed on Sep. 8, 2023.

(51) Int. Cl.
*E04F 11/035* (2006.01)
*E04F 11/02* (2006.01)
*E04F 11/025* (2006.01)
*E04F 11/06* (2006.01)

(52) U.S. Cl.
CPC ..... *E04F 11/0255* (2013.01); *E04F 11/0201* (2013.01); *E04F 11/035* (2013.01); *E04F 11/06* (2013.01); *E04F 2201/043* (2013.01)

(58) Field of Classification Search
CPC ..... E04F 11/0255; E04F 11/0201; E04F 2201/043; E04F 11/035; E04F 11/06
USPC ..... 52/182, 183, 36.1, 36.6, 481.2, 36.5, 52/282.2, 586.1, 775, 188; 119/849
See application file for complete search history.

(56) References Cited

U.S. PATENT DOCUMENTS 1,635,183 A * 7/1927 Jeannotte ..... A47B 83/00 182/129
1,973,628 A * 9/1934 Hindle ..... A47C 12/02 312/298
2,563,436 A * 8/1951 Toth ..... A47C 12/02 312/235.1
3,486,287 A * 12/1969 Guillon ..... F16B 12/02 52/775
3,564,790 A * 2/1971 Rehfeld ..... E04F 11/06 108/92
4,580,776 A * 4/1986 Burkinshaw ..... E04H 3/24 312/258
5,692,445 A * 12/1997 Winer ..... A47F 5/16 108/100
6,029,406 A * 2/2000 Staehlin ..... E04H 3/126 52/9
6,751,914 B2 * 6/2004 Zeh ..... A47B 83/001 248/223.41
8,701,830 B2 * 4/2014 Merey ..... E06C 1/383 108/92
D742,079 S * 10/2015 Jakubowski ..... D30/199
2003/0107306 A1 * 6/2003 Strong ..... A47B 81/002 312/409
2004/0079297 A1 * 4/2004 Wolfington ..... A01K 1/035 119/849
2006/0248817 A1 * 11/2006 Elwood ..... A63B 71/02 52/182
2008/0040991 A1 * 2/2008 Gianelo ..... E04F 11/035 52/182

(Continued)

FOREIGN PATENT DOCUMENTS

IT 1058793 B * 5/1982

*Primary Examiner* — Brent W Herring

(57) ABSTRACT

A splicing step device includes a first step body and a second step body. A height of the first step body is different from a height of the second step body, and the first step body is configured by splicing. The splicing step device is detachable, which reduces a space occupied by the splicing step device during storage and transportation, and reduces storage costs as well as transportation costs.

18 Claims, 19 Drawing Sheets

(56) References Cited

U.S. PATENT DOCUMENTS

2008/0257280 A1* 10/2008 Jakubowski ..... A01K 1/035
119/849
2016/0331135 A1* 11/2016 Knudson ..... A47B 87/0215

* cited by examiner

SPLICING STEP DEVICE

TECHNICAL FIELD

The present disclosure relates to a technical field of steps, and in particular to a splicing step device.

BACKGROUND

Steps include fixed steps and detachable steps. The fixed steps are, for example, conventional steps in the buildings and steps in scenic areas.

The detachable steps generally include a frame and plates. The frame serves as a main part of the steps, and the frame includes at least two mounting portions, where each of the mounting portions is for mounting a corresponding plate. Each of the plates is mounted a corresponding mounting portion to form a step thereof. The detachable steps may be applied indoors or outdoors, for example, in a swimming pool, a spa, and the like.

However, the step body of the detachable steps in the related art is large in size. The processing plant needs a sufficiently large space to store the step body and the plates, thereby increasing the cost. In addition, in actual transportation processes, the large size of the step body takes up too much space in transportation means, resulting in a decrease in the actual transportation capacity of the transportation means and an increase in the transportation cost.

SUMMARY OF THE DISCLOSURE

Embodiments of the present disclosure provide a splicing step device that reduces a space occupied by the splicing step device during storage and transportation and reduces storage costs as well as transportation costs.

In one optional embodiment, the first step body comprises first plate elements and first connecting elements. The first plate elements and the first connecting elements are detachably connected to assemble the first step body:

In one optional embodiment, the first plate elements comprise first splice plates and first side plates, the first splice plates being disposed at front and rear sides of the first side plates. Each of the first connecting elements is connected to at least one of the first splice plates and at least one of the first side plates. Each of the first splice plates is detachably connected to two of the first connecting elements. Each of the first side plates is detachably connected to two of the first connecting elements.

In one optional embodiment, the first side plates and the first splice plates are assembled together through the first connecting elements to define one or more first accommodating cavities.

The first step body further comprises one or more first pedals. The one or more first pedals are detachably connected to the first splice plates, the first side plates, and the first connecting elements. Each of the first pedals covers on a corresponding first accommodating cavity.

In one optional embodiment, each of the first side plates is connected between adjacent two of the first connecting elements.

The adjacent two of the first connecting elements are jointly connected to corresponding two of the first side plates, and the corresponding two of the first side plates are disposed side by side along a height direction of the splicing step device.

In one optional embodiment, three first side plates are provided, and the three first side plates are spaced apart along a length direction of the first step body.

Eight first splice plates are provided, and six first connecting elements are provided.

The first splice plates and the first side plates are assembled together through the first connecting elements to define two first accommodating cavities.

The first step body further comprises two first pedals. The two first pedals are detachably connected to the eight first splice plates, the three first side plates, and the six first connecting elements: the two first pedals respectively covers on the two first accommodating cavities.

In one optional embodiment, the first connecting elements are first connecting posts each defining first slots. Each of the first plate elements comprises two first sliders, and the two first sliders of each of the first plate elements are disposed at both ends of each of the first plate elements. Each of the first sliders is insertable into a corresponding one of the first slots and is slidable within the corresponding one of the first slots.

In one optional embodiment, each of the first slots is continuous or defines at least one notch.

In one optional embodiment, four first slots are defined on each of the first connecting elements, and the four first slots of each of the first connecting posts are evenly disposed on four sides of each of the first connecting posts.

Each of the first connecting posts further comprises a first connecting body and four first connecting structures disposed around the first connecting body. Each of the first slots is disposed between corresponding adjacent two first connecting structures. The four first connecting structures of each of the first connecting posts are disposed at four corners of each of the first connecting posts.

Each first connecting body is hollow, and each first connecting structure is hollow.

In one optional embodiment, adjacent two of the first plate elements are connected to at least two of the first connecting elements.

Each of the first connecting elements comprises a screw or a corner connector.

In one optional embodiment, the adjacent two of the first plate elements are connected through a limiting structure. Each limiting structure comprises a limiting groove and a limiting portion. The limiting groove is disposed in a first one of the adjacent two of the first plate elements, and each of the limiting portions is disposed in a second one of the adjacent two of the first plate elements.

In one optional embodiment, the first step body comprises first plate elements. The first plate elements are capable of being directly assembled to assemble the first step body.

a first end of each of the first plate elements defines a slot, and a slider is disposed on a second end of each of the first plate elements In one optional embodiment, a height of the first step body is greater than a height of the second step body; and the first step body and the second step body are splicable.

The height of the first step body is substantially twice the height of the second step body.

In one optional embodiment, a height of the first step body is greater than a height of the second step body, and the first step body and the second step body are configured by splicing. The second step body comprises second plate elements and second connecting elements, the second plate elements and the second connecting elements being detachably connected to assemble the second step body. The second plate elements and the first connecting elements are detachably connected to assemble the first step body and the second step body.

In one optional embodiment, the first connecting elements are first connecting posts defining first slots. Each of the first plate elements comprises two first sliders respectively disposed at both ends of each of the first plate elements. Each of the first sliders is insertable into a corresponding one of the first slots and is slidable within the corresponding one of the first slots.

The second connecting elements are second connecting posts each defining second slots. Each of the second plate elements comprises two second sliders, and the two second sliders of each of the second plate elements are disposed at both ends of each of the second plate elements. Each of the second sliders is insertable into a corresponding one of the second slots and is slidable within the corresponding one of the second slots.

In one optional embodiment, a shape of a cross section of each of the first connecting posts and a shape of a cross section of each of the second connecting posts are substantially the same. A height of each of the first connecting posts is greater than or substantially equal to twice a height of each of the second connecting posts.

In one optional embodiment, each of the first plate elements comprises first reinforcing bars disposed on a side thereof and on a circumference thereof. Each of the second plate elements comprises second reinforcing bars disposed on one side thereof and on a circumference thereof. The first reinforcing bars and the second reinforcing bars are disposed within the splicing step device.

In one optional embodiment, a height of the first step body is greater than a height of the second step body; and the first step body and the second step body are configured by splicing.

The second step body comprises second plate elements and second connecting elements, the second plate elements and the second connecting elements being detachably connected to splice up the second step body: The second plate elements comprises second splice plates and second side plates, the second splice plates and the first splice plates being disposed on front and rear sides of the second side plates: each of the second connecting elements is connected to at least one of the second splice plates and at least one of the second side plates. Each of the second splice plates is detachably connected to two of the second connecting elements. Each of the second side plates is detachably connected to one of the first connecting elements and one of the second connecting elements.

In one optional embodiment, a shape of each of the first splice plates and a shape of each of the second splice plates are substantially the same. A size of each of the first splice plates and a size of each of the second splice plates are substantially the same. A width of each of the first side plates and a width of each of the second side plates are substantially equal, and a height of each of the first side plates is greater than or substantially equal to twice height of each of the second side plates.

In one optional embodiment, adjacent two of the first connecting elements are jointly connected to a corresponding one of the first side plates. The first step body further comprises third splice plates detachably connected to the first connecting elements. Adjacent two of the first connecting elements are jointly connected to a corresponding one of the third splice plates, and each of the third splice plates is disposed between corresponding two of the first splice plates. Adjacent two of the first connecting elements are jointly connected to a corresponding one of the third splice plates and corresponding two of the first splice plates, and the corresponding two of the first side plates and the corresponding one of the third splice plates are disposed side-by-side along a height direction of the splicing step device. The second side plates and the second splice plates are assembled together through the second connecting elements to define one or more second accommodating cavities.

The second step body further comprises one or more second pedals. The one or more second pedals are detachably connected to the second splice plates, the second side plates, and the second connecting elements. Each of the second pedals covers on a corresponding second accommodating cavity.

A thickness of each of the second pedals is substantially equal to a height of each of the third splice plates.

The first step body and the second step body of the splicing step device of the embodiments of the present disclosure are splicable. When not assembled, the first step body and the second step body each occupies a volume less than a volume of a step body having steps. Therefore, during storage or transportation, the first step body and the second step body are not assembled, reducing the space occupied for storing or transporting the splicing step device, and reducing the storage or transportation cost of the assembled step device.

The first step body and the second step body are assembled to form the splicing step device having steps.

The first step body and the second step body of the splicing step device of the embodiments of the present disclosure are splicable. When not assembled, the first step body and the second step body each occupies a volume less than a volume of a step body having steps. Therefore, during storage or transportation, the first step body and the second step body are not assembled, reducing the space occupied for storing or transporting the splicing step device, and reducing the storage or transportation cost of the assembled step device.

The first step body and the second step body are assembled to form the splicing step device having steps.

BRIEF DESCRIPTION OF THE DRAWINGS

In order to more clearly illustrate the technical solutions in the embodiments of the present disclosure, the accompanying drawings to be used in the description of the embodiments will be briefly described below. Obviously, the accompanying drawings in the following description are only some of the embodiments of the present disclosure, and other accompanying drawings may be obtained by those skilled in the art based on these drawings without creative labor.

For a more complete understanding of the present disclosure and its beneficial effects, the following description will be given in conjunction with the accompanying drawings, where same accompanying symbols in the following description denote same parts.

DETAILED DESCRIPTION

The technical solutions in the embodiments of the present disclosure will be clearly and completely described below in conjunction with the accompanying drawings in the embodiments of the present disclosure. Obviously, the described embodiments are only a part of the embodiments of the present disclosure, and not all the embodiments. The following description of at least one exemplary embodiment is in fact merely illustrative and is not to be taken as any limitation of the present disclosure and its application or use. Based on the embodiments in the present disclosure, all other embodiments obtained by those skilled in the art without creative labor fall within the scope of the present disclosure.

References herein to "embodiments" or "implementations" imply that a particular feature, structure, or characteristic described in conjunction with one embodiment or implementation may be included in at least one embodiment of the present disclosure. The presence of the phrase at various points in the specification does not necessarily refer to the same embodiment, nor is it a separate or alternative embodiment that is mutually exclusive of other embodiments. It is understood by those skilled in the art, both explicitly and implicitly, that the embodiments described herein may be combined with other embodiments.

Figure 1:
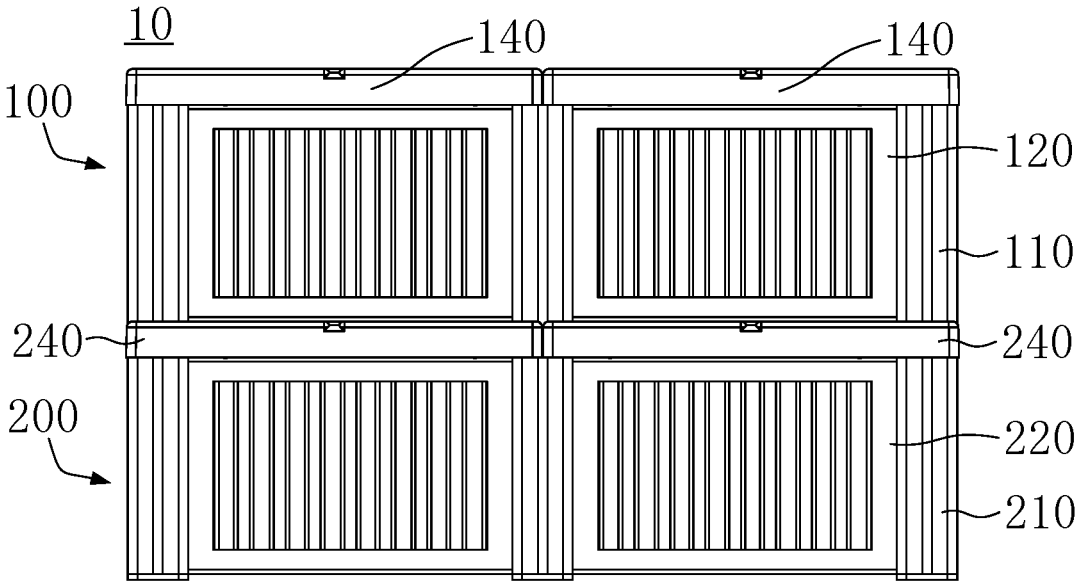
FIG. 1 is a front schematic diagram of a splicing step device according to one embodiment of the present disclosure.
Figure 2:
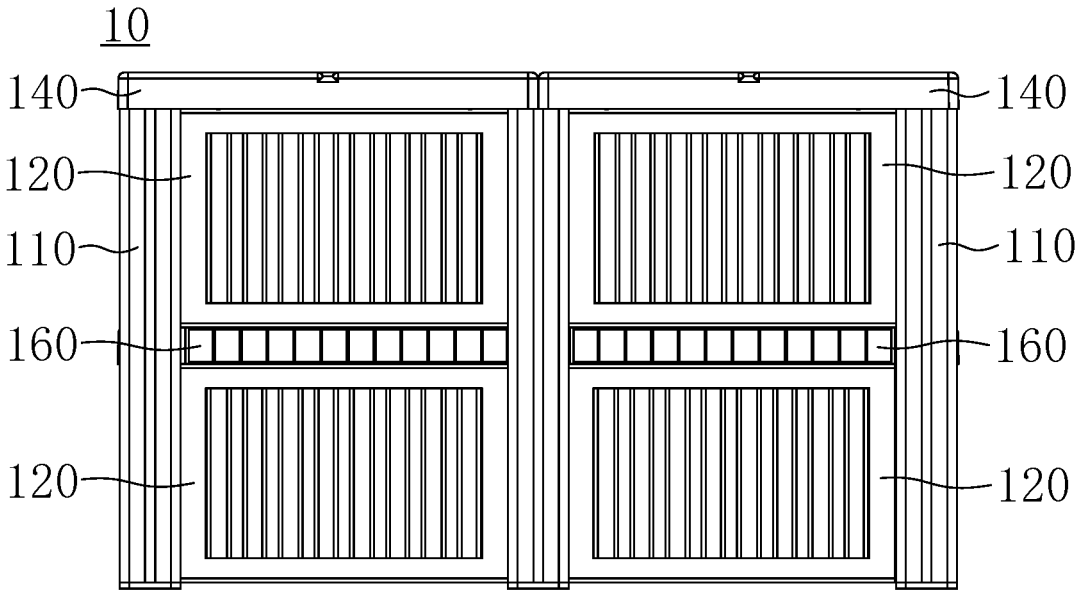
FIG. 2 is a rear schematic diagram of the splicing step device according to one embodiment of the present disclosure.
Figure 3:
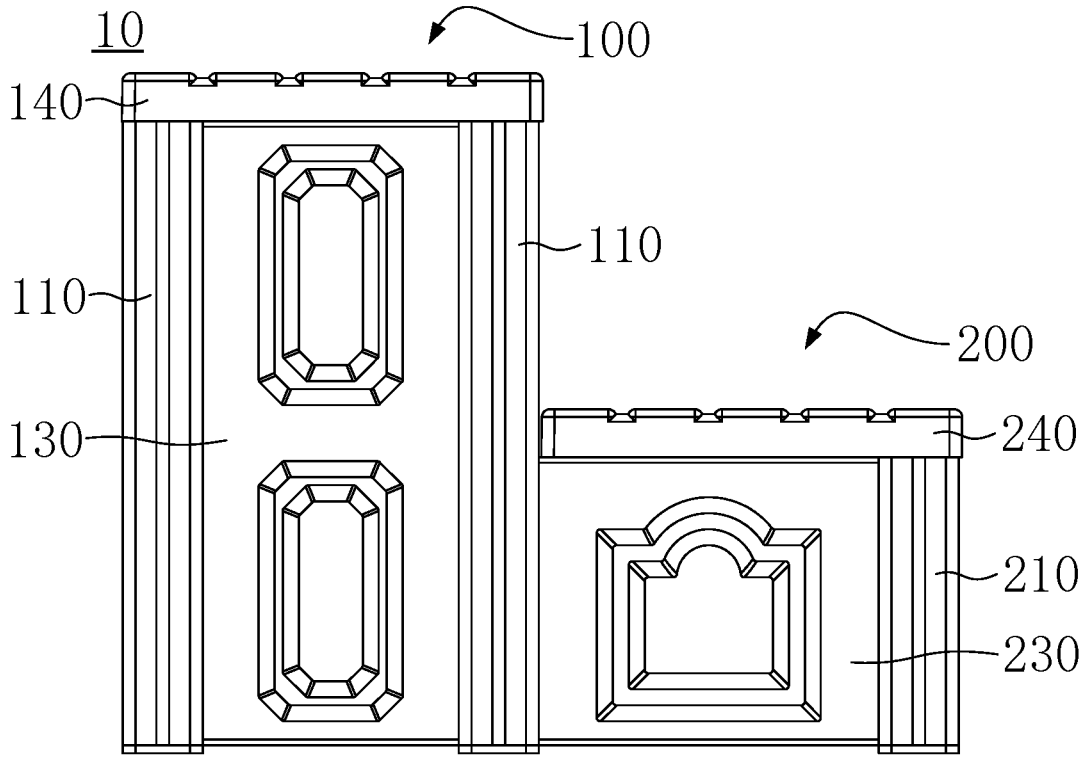
FIG. 3 is a side schematic diagram of the splicing step device according to one embodiment of the present disclosure.
Figure 4:
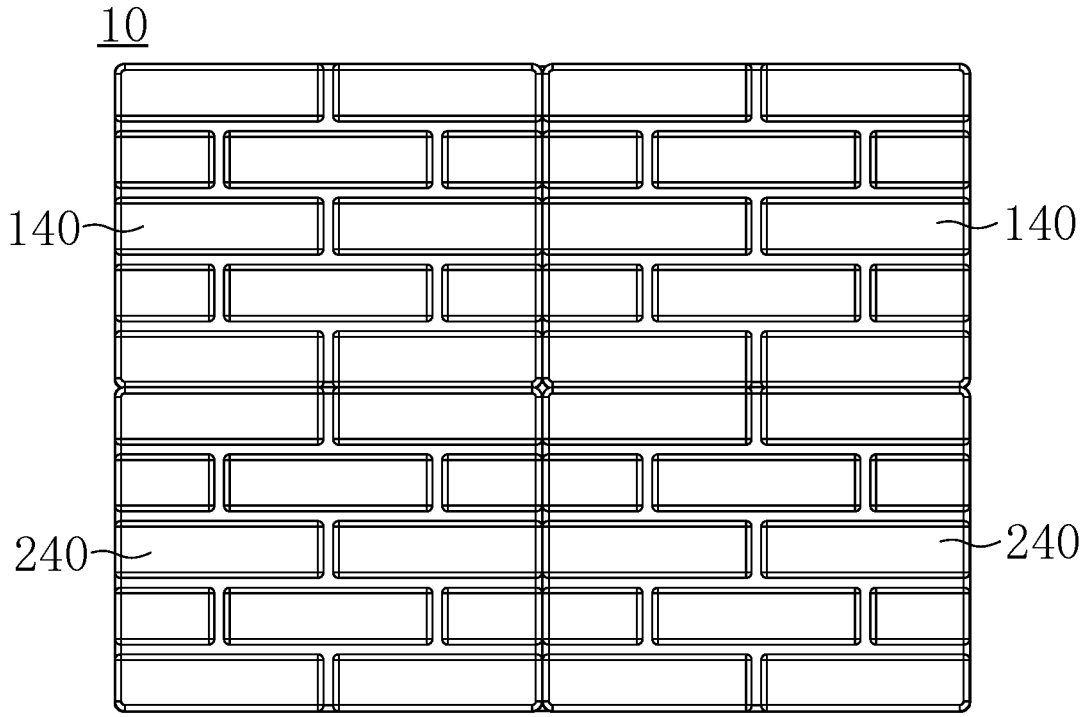
FIG. 4 is a top schematic diagram of the splicing step device according to one embodiment of the present disclosure.
Figure 5:
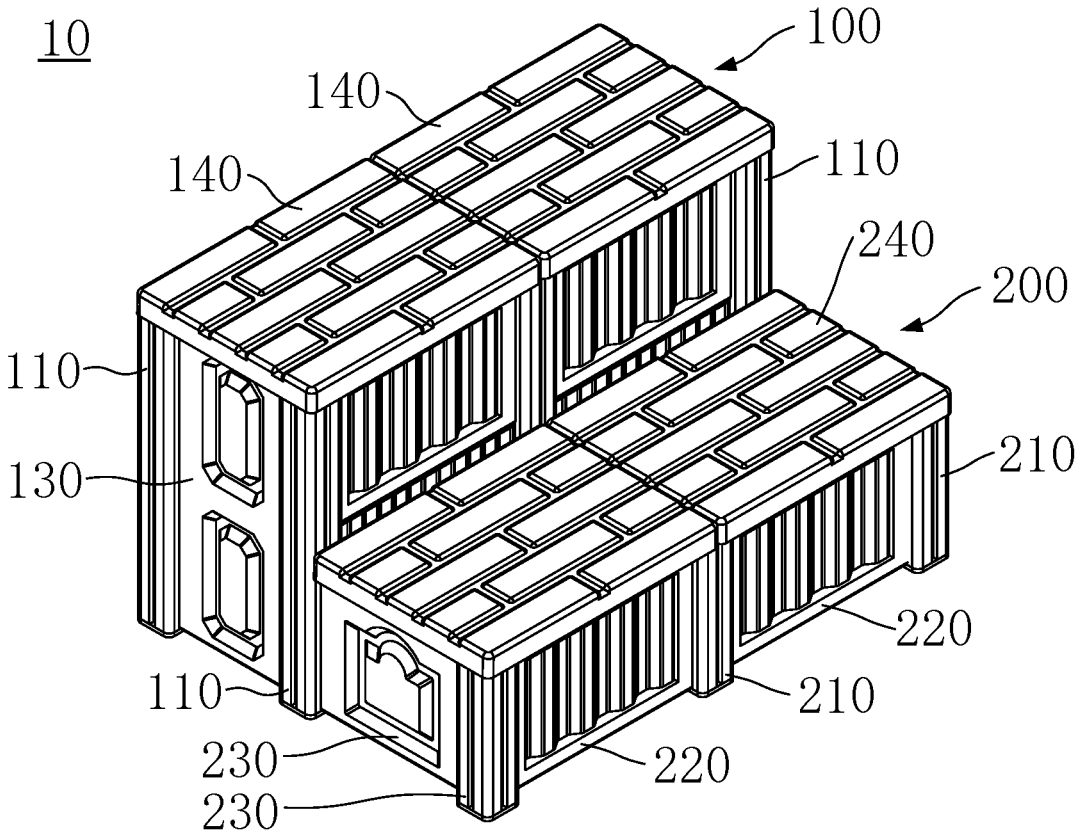
FIG. 5 is a perspective schematic diagram of the splicing step device according to one embodiment of the present disclosure in a schematic diagraming angle.
Figure 6:
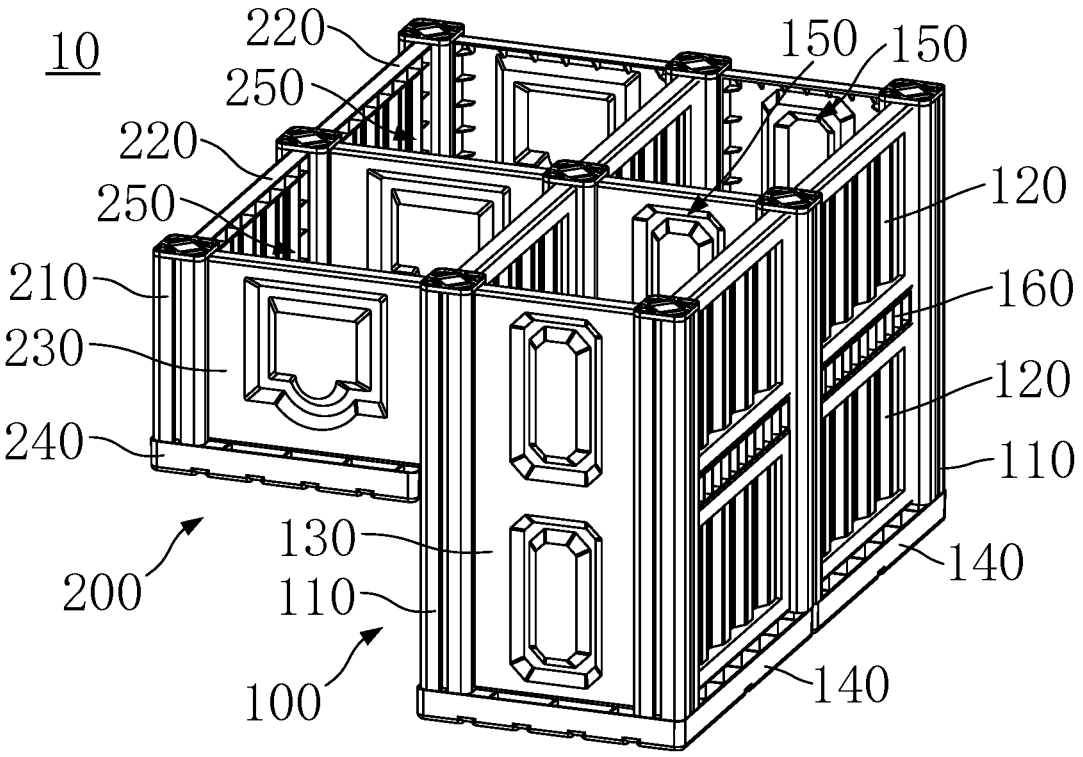
FIG. 6 is another perspective schematic diagram of the splicing step device according to one embodiment of the present disclosure.

Referring to FIGS. 1 to 6. FIG. 1 is a front schematic diagram of a splicing step device according to one embodiment of the present disclosure. FIG. 2 is a rear schematic diagram of the splicing step device according to one embodiment of the present disclosure. FIG. 3 is a side schematic diagram of the splicing step device according to one embodiment of the present disclosure. FIG. 4 is a top schematic diagram of the splicing step device according to one embodiment of the present disclosure. FIG. 5 is a perspective schematic diagram of the splicing step device according to one embodiment of the present disclosure in a schematic diagraming angle, and FIG. 6 is another perspective schematic diagram of the splicing step device according to one embodiment of the present disclosure.

The present embodiments provide the splicing step device 10, and the splicing step device 10 is abbreviated to a step device 10 or a splicing step. The splicing step device 10 can be assembled together or can be disassembled. For instance, the splicing step device 10 is assembled along a width direction thereof. For example, the splicing step device 10 includes step bodies, and each two adjacent step bodies are assembled to form the splicing step device 10. The splicing step device 10 is also disassembled into the step bodies. The step bodies have different heights. Alternatively: the splicing step device 10 is assembled along a length direction. For example, the splicing step device 10 includes splicing portions, and each two adjacent splicing portions are assembled to form the splicing step device 10. The splicing step device 10 is disassembled into the splicing portions. The splicing portions may be the same or different. Description is provided below in conjunction with the accompanying drawings.

Figure 7:
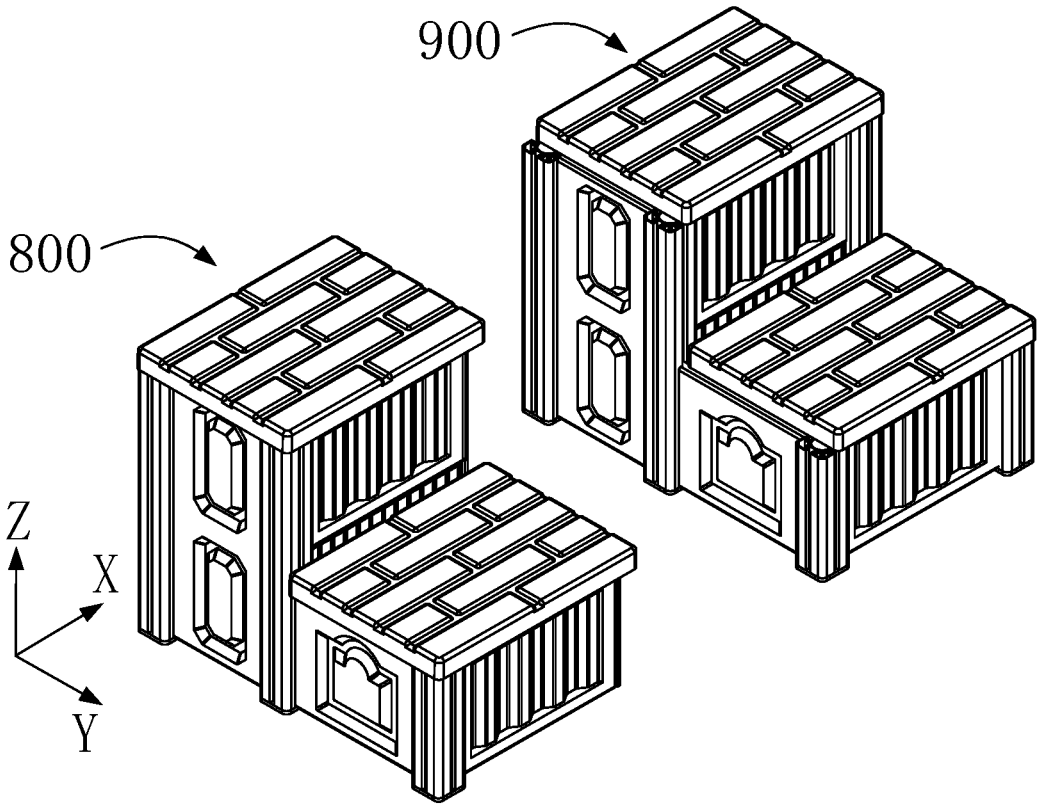
FIG. 7 is a schematic diagram schematic diagram of the splicing step device according to one embodiment of the present disclosure in a first state.

In conjunction with FIG. 7. FIG. 7 is a schematic diagram schematic diagram of the splicing step device according to one embodiment of the present disclosure in a first state. The splicing step device 10 includes a first splicing portion 800 and a second splicing portion 900, and the first splicing portion 800 and the second splicing portion 900 are assembled to form the splicing step device 10. The splicing step device 10 may also be detached into the first splicing portion 800 and the second splicing portion 900 for being used separately. It is understood that the first splicing portion 800 and the second splicing portion 900 included in the splicing step device 10 of the present embodiments are only exemplary: and the number of splicing portions included in the splicing step device 10 is not limited to two, but may be other numbers, such as three, four, five, and the like.

It is noted that after the first splicing portion 800 and the second splicing portion 900 are assembled to form the splicing step device 10, it is possible that the first splicing portion 800 and the second splicing portion 900 are not detachable.

Figure 8:
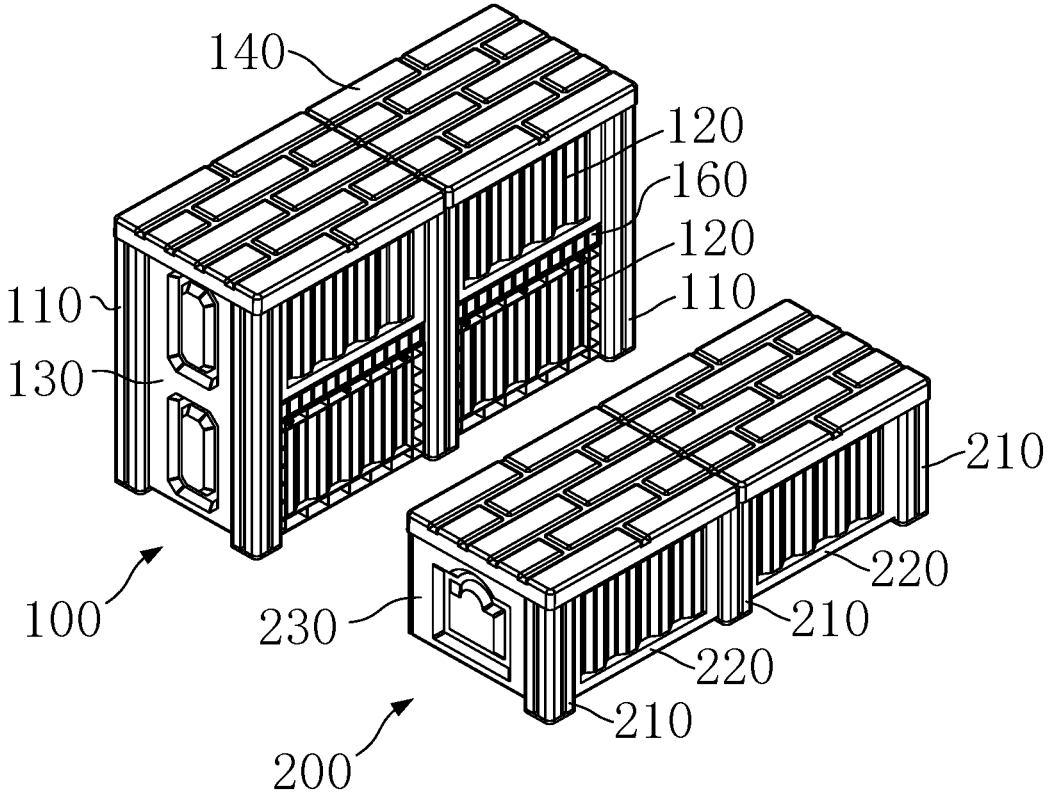
FIG. 8 is a schematic diagram schematic diagram of the splicing step device according to one embodiment of the present disclosure in a second state.

In conjunction with FIG. 8. FIG. 8 is a schematic diagram schematic diagram of the splicing step device according to one embodiment of the present disclosure in a second state. The splicing step device 10 includes a first step body 100 and a second step body 200, and the first step body 100 and the second step body 200 are configured by splicing and are assembled to form the splicing step device 10. The splicing step device 10 can be detached into the first step body 100 and the second step body 200 for being separately used. It is understood that the first step body 100 and the second step body 200 included in the splicing step device 10 of the present embodiments are only exemplary: and the number of step bodies included in the splicing step device 10 is not limited to two, but may be other numbers, such as three, four, five, and the like.

It should be noted that after the first step body 100 and the second step body 200 are assembled together to form the splicing step device 10, it is possible that the first step body 100 and the second step body 200 are not detachable.

As shown in FIG. 7, a length direction of the splicing step device 10 is referenced to direction X, a width direction of the splicing step device 10 is referenced to direction Y. and a height direction of the splicing step device 10 is referenced to direction Z.

It is understood that in some embodiments of the present disclosure, the splicing step device 10 are splicable along the length direction, such as shown in FIG. 7: and the splicing step device is splicable along the width direction, such as shown in FIG. 8. It should be understood that the splicing step device 10 is detachable along the length direction and is also detachable along the width direction. That is, the splicing step device 10 of the embodiments of the present disclosure is assembled in at least two directions, and compared to a step device that is not detachable, the splicing step device 10 is disassembled when storing or transporting the splicing step device 10, thereby reducing a space occupied by the splicing step device during storage or transportation and reducing the cost of storage or transportation.

In some embodiments of the present disclosure, each of the splicing portions of the splicing step device 10 are configured by splicing, or each of the step bodies of the splicing step device 10 is configured by splicing. The first step body 100 are configured by splicing and the second step body 200 is configured by splicing, which are illustrated below in conjunction with the accompanying drawings. It is noted that it is possible that the first step body 100 is configured by splicing while the second step body 200 is not configured by splicing. It is also noted that it is also possible that the second step body 200 is configured by assembling while the first step body 100 is not configured by splicing.

Figure 9:
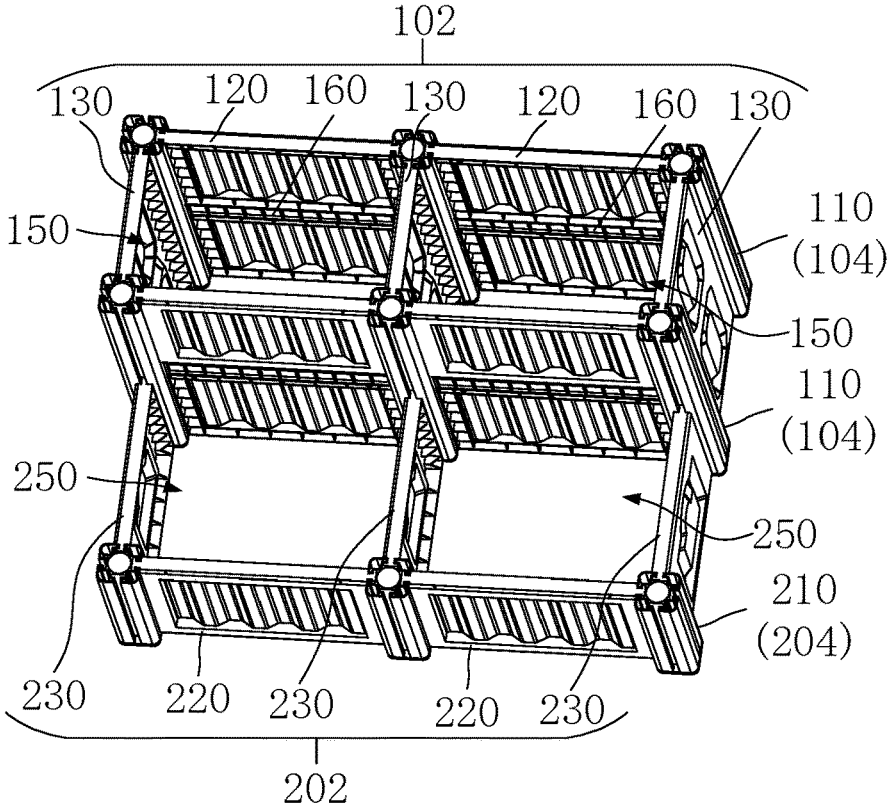
FIG. 9 is a first partial schematic diagram schematic diagram of the splicing step device according to one embodiment of the present disclosure.
Figure 10:
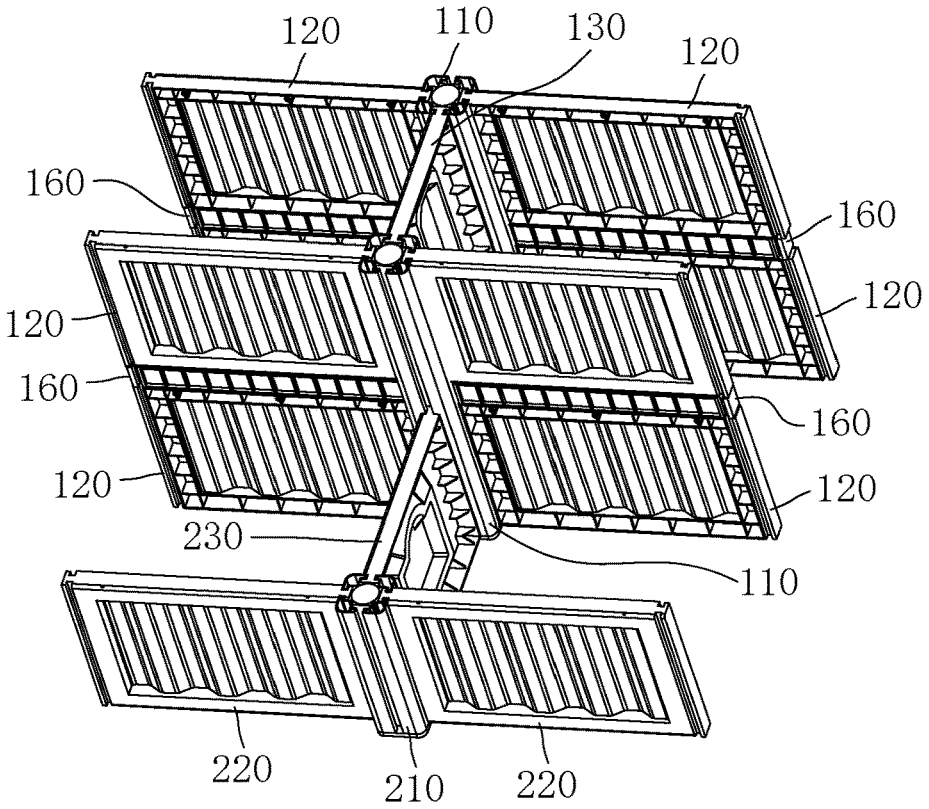
FIG. 10 is a second partial schematic diagram schematic diagram of the splicing step device according to one embodiment of the present disclosure.
Figure 11:
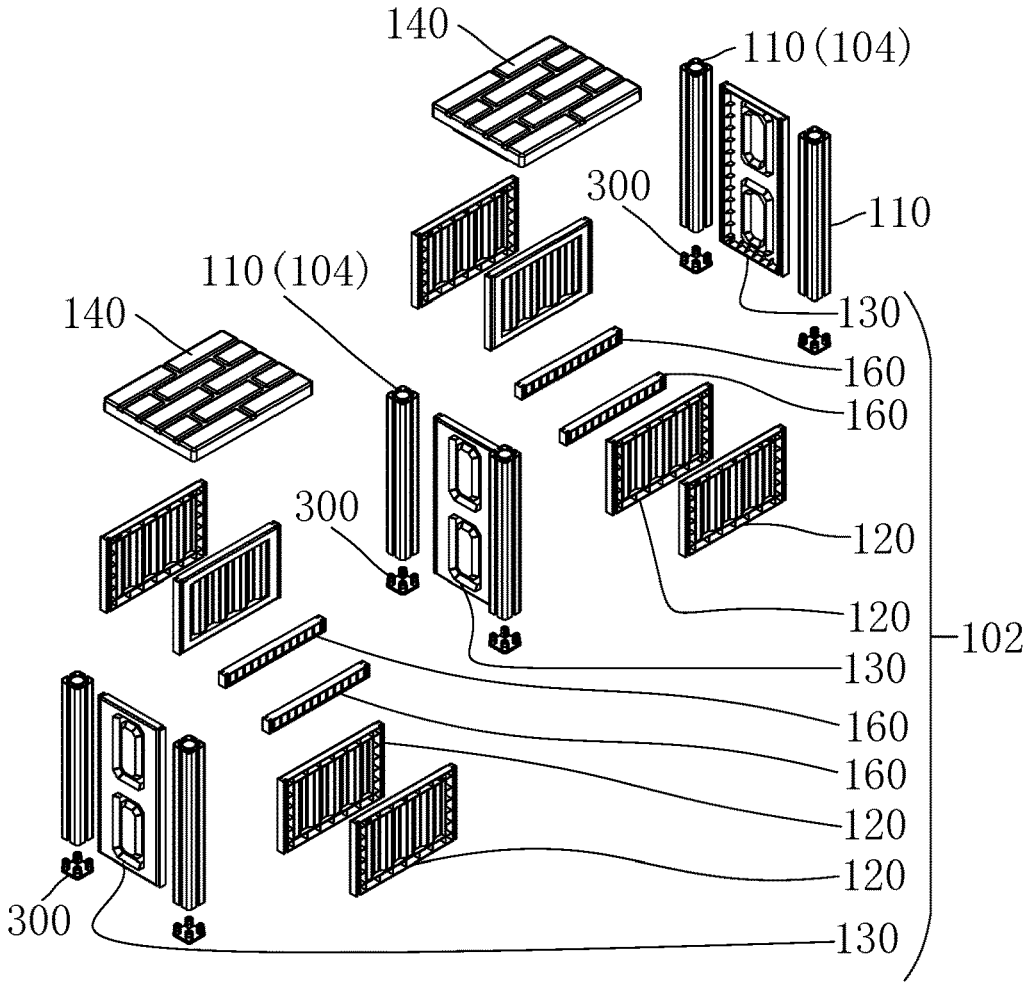
FIG. 11 is an exploded schematic diagram of a first step body in the splicing step device according to one embodiment of the present disclosure.
Figure 12:
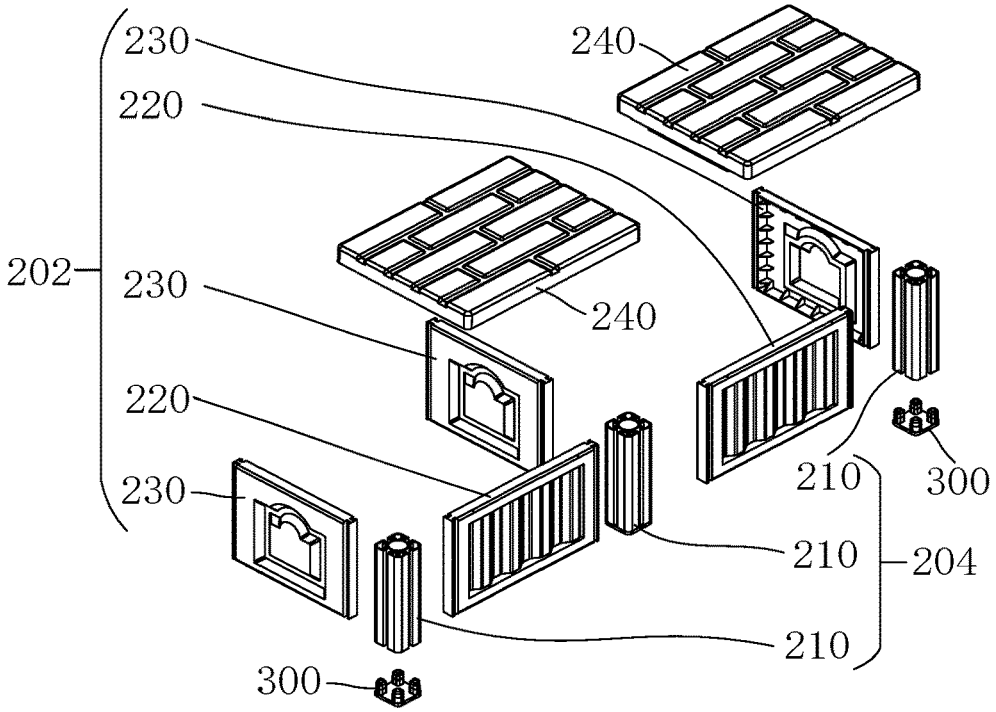
FIG. 12 is an exploded schematic diagram of a second step body in the splicing step device according to one embodiment of the present disclosure.

As shown in FIGS. 9 to 12. FIG. 9 is a first partial schematic diagram schematic diagram of the splicing step device according to one embodiment of the present disclosure. FIG. 10 is a second partial schematic diagram schematic diagram of the splicing step device according to one embodiment of the present disclosure. FIG. 11 is an exploded schematic diagram of the first step body in the splicing step device according to one embodiment of the present disclosure, and FIG. 12 is an exploded schematic diagram of the second step body in the splicing step device according to one embodiment of the present disclosure.

The first step body 100 configured by splicing is taken as an example for illustration first. The first step body 100 includes first plate elements 102 and first connecting elements 104. The first plate elements 102 and the first connecting elements 104 are detachably connected, so that the first step body is splicable.

The first plate elements 102 and the first connecting elements 104 are detachably connected by connecting posts, screws, or corner connectors, which are further described below in conjunction with the accompanying drawings. It is understood that structures realizing the detachable connection of the first plate elements 102 and the first connecting elements 104 are all within the scope of the present disclosure.

The first plate elements 102 may be first plate structures of substantially the same size and same shape. Alternatively: the first plate elements 102 are first plate structures of different sizes and shapes. The first plate elements 102 including two types of first plate structures are illustrated below in conjunction with the accompanying drawings.

The first plate elements 102 include first splice plates 120 and first side plates 130, the first splice plates 120 being disposed at front and rear sides of the first side plates 130. Each of the first connecting elements 104 is connected to at least one of the first splice plates 120 and at least one of the first side plate 130*s*. Each of the first splice plates 120 is detachably connected to corresponding two of the first connecting elements 104, and each of the first side plates 130 is detachably connected to corresponding two of the first connecting elements 104, thereby realizing the assembly and disassembly of the first step body 100. For example, the first step body 100 can be disassembled into the first splice plates 120, the first side plates 130, and the first connecting elements 104.

It is understood that the first splice plates 120 have substantially the same shape and same size, and the first side plates 130 have substantially the same shape and same size.

In some embodiments of the present disclosure, the first side plates 130 and the first splice plates 120 are assembled together through the first connecting elements 104 to define one or more first accommodating cavities 150. In the embodiments of the present disclosure, two accommodating cavities are taken as an example for illustration. It will be appreciated that the number of the first accommodating cavities 150 may be three, four, etc., which is not limited therein.

Figure 13:
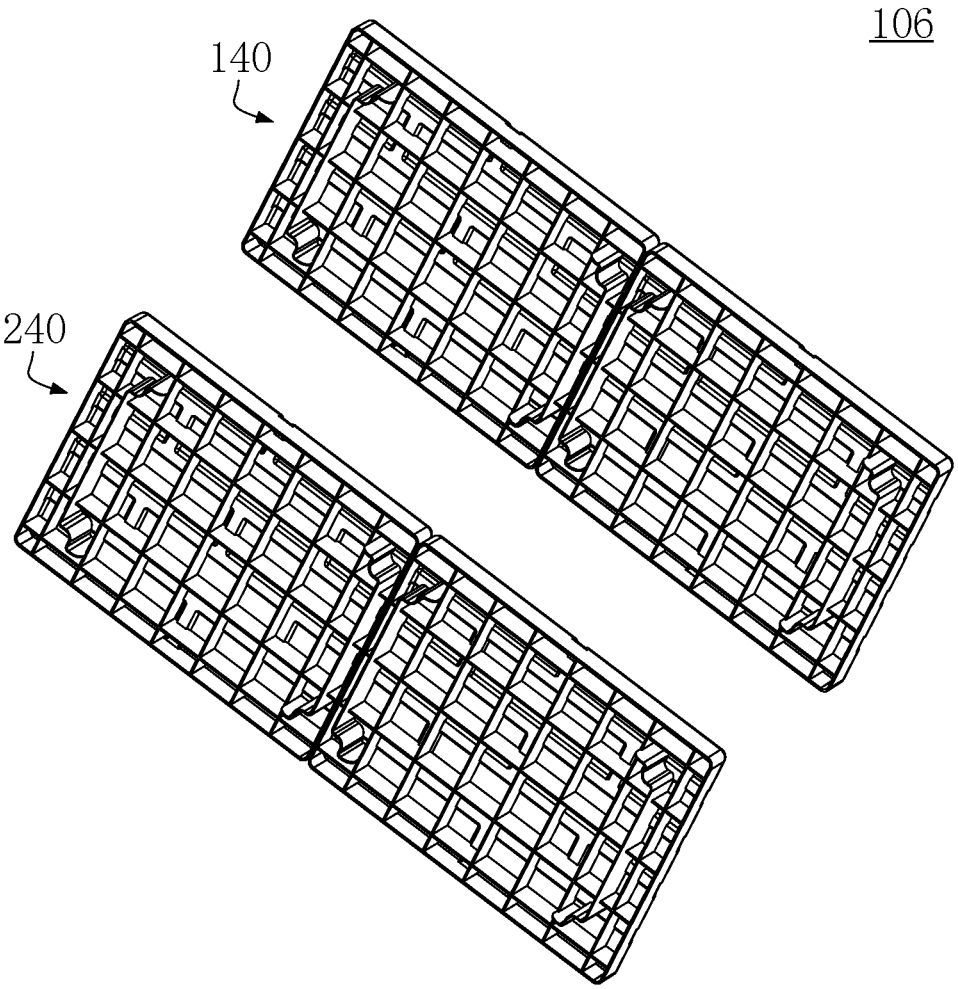
FIG. 13 is a structural schematic diagram schematic diagram of a pedal in the splicing step device according to one embodiment of the present disclosure.

As shown in FIG. 13. FIG. 13 is a structural schematic diagram schematic diagram of a pedal in the splicing step device according to one embodiment of the present disclosure. The splicing step device 10 further includes pedals 106, and the pedals 106 include one or more first pedals 140 and one or more second pedals 240. The number of the first pedals 140 and the number of the second pedals 240 may be equal, and the number of the first pedals 140 of the embodiments of the present disclosure is exemplified as two, as well as the number of the second pedals 240 is also exemplified as two. It is appreciated that the number of the first pedals 140 may be other numbers, such as three, four, etc. The number of the second pedals 240 may also be other numbers, such as three, four, etc.

In some embodiments of the present disclosure, the first pedals 140 have substantially the same shape as the second pedals 240, and/or the first pedals 140 have substantially the same size as the second pedals 240. It is noted that the shape of each of the first pedals 140 may be different from the shapes of each of the second pedals 240, and the size of each of the first pedals 140 may be different from the size of each of the second pedals 240.

The one or more first pedals 140 are detachably connected to the first splice plates 120, the first side plates 130, and the first connecting elements 104, with each of the first pedals 140 covering a corresponding first accommodating cavity 150. In some embodiments of the present disclosure, the one or more first pedals 140 are detachably connected to the first splice plates 120, the first side plates 130, and the first connecting elements 104 in an interference fit.

In the embodiments of the present disclosure, the first step body 100 is detachable into individual components, or it is understood that the splicing step device 10 is splicable in three directions, namely, along the length direction, the width direction, and the height direction thereof. Therefore, during storage or transportation of the splicing step device 10, the splicing step device 10 can be disassembled into the individual components which further reduces the space occupied by the splicing step device 10, and further saves transportation or storage costs. Moreover, the splicing step device 10 of the embodiments of the present disclosure can be assembled with other splicing step devices 10 to have different sizes, which increases the fun of the shopping experience.

In some embodiments of the present disclosure, each of the first side plates 130 are connected between adjacent two of the first connecting elements 104, the adjacent two of the first connecting elements 104 are connected to corresponding two of the first splice plates 120, and the corresponding two of the first splice plates 120 connected to the two adjacent first connecting elements 104 are disposed side by side along the height direction of the splicing step device 10. In other embodiments of the present disclosure, the two adjacent first connecting elements 104 are connected to a corresponding one of the first side plates 130, such as two corresponding one of the first side plates 130, three corresponding first side plates 130.

Any of the first connecting elements 104 disposed at a corner of the splicing step device 10 may be detachably connected to corresponding two of the first splice plates 120 that are stacked, as well as detachably connected to a corresponding one of the first side plates 130. The corresponding two of the first splice plates 120 thereof and the corresponding one of the first side plates 130 connected by the same first connecting element 104 may be bent to each other. For example, any one of the first splice plates 120 and any one of the first side plates 130 are perpendicular. The first side plates 130 are parallel to each other, and the first splice plates 120 located on the front and rear sides of each of the first connecting elements 104 are parallel to each other. Each of the first connecting elements 104 at a middle position of the splicing step device 10 may be connected to a corresponding one of the first side plates 130 and corresponding four of the first splice plates 120.

In other embodiments of the present disclosure, adjacent two of the first connecting elements 104 may be jointly connected to a corresponding one of the first splice plates 120. Alternatively, the adjacent two of the first connecting elements 104 may be jointly connected to other numbers of first splice plates 120, such as three first splice plates 120, four first splice plates 120, etc.

In some embodiments of the present disclosure, three first side plates 130 are provided, the three first side plates 130 being spaced apart along a length direction of the first step body 100. Eight first splice plates 120 are provided, and six first connecting elements 104 are provided. The eight first splice plates 120 and the three first side plates 130 are assembled together through the six first connecting elements 104 to define two first accommodating cavities 150. Two first pedals 140 are detachably connected to the eight first splice plates 120, the three first side plates 130, and the six first connecting elements 104.

The length direction of the first step body 100 can be understood as the length direction of the splicing step device 10.

As shown in FIGS. 1 to 13, the second step body 200 is configured by assembling and the splicing step device 10 assembled by the first step body 100 and the second step body 200 are described below.

In some embodiments of the present disclosure, the height of the first step body 100 is greater than the height of the second step body 200, such as the height of the first step body 100 is substantially twice the height of the second step body 200.

The second step body 200 includes second plate elements 202 and second connecting elements 204, the second plate elements 202 and the second connecting elements 204 being detachably connected, so that the second step body 200 is configured by assembling. The second plate elements 202 and the first connecting elements 104 are detachably connected, so that the first step body 100 is capable of being assembled with the second step body 200.

The second plate elements 202 and the second connecting elements 204 are detachably connected by connecting posts, screws, or corner connectors, which are further described below in conjunction with the accompanying drawings. It is understood that structures capable of realizing the detachable connection of the second plate elements 202 and the second connecting elements 204 are all within the scope of the present disclosure.

The second plate elements 202 may be second plate structures of substantially the same size and same shape. Alternatively, the second plate elements 202 may be second plate structures of different sizes and shapes. The second plate elements 202 including two types of second plate structures are illustrated below in conjunction with the accompanying drawings as an example.

The second plate elements 202 include second splice plates 220 and second side plates 230, the second splice plates 220 and the first splice plates 120 being disposed on front and rear sides of the second side plates 230. Each of the second connecting elements 204 is connected to at least one of the second splice plate 220 and at least one of the second side plate 230. Each of the second splice plates 220 is detachably connected to corresponding two of the second connecting elements 204, and each of the second side plates 230 is detachably connected to a corresponding one of the first connecting elements 104 and a corresponding one of the second connecting elements 204, thereby realizing that the second step body 200 is configured by assembling and realizing that the second step body 200 is detachable into individual components For example, the second step body 200 can be disassembled into second splice plates 220, second side plates 230, and second connecting elements 204, and second connecting elements 204, so that the first step body 100 and the second step body 200 can be formed by being assembled and be detachable.

It is understood that the second splice plates 220 have substantially the same shape and same size, and the second side plates 230 have substantially the same shape and same size.

In some embodiments of the present disclosure, the second side plates 230, the second splice plates 220, and the first splice plates 120 are assembled together through the first connecting elements 104 and the second connecting elements 204 to define one or more second accommodating cavities 250. The second accommodating cavities 250 of the embodiments of the present disclosure are illustrated in the example of two in number. It will be appreciated that the number of the second accommodating cavities 250 may be other numbers, such as three, four, etc.

The one or more second pedals 240 are detachably connected to the second splice plates 220, the second side plates 230, and the second connecting elements 204, with each of the second pedals 240 covering a corresponding one of the second accommodating cavities 250. In some embodiments of the present disclosure, the one or more second pedals 240 are detachably connected to the second splice plates 220, the second side plates 230, and the second connecting elements 204 in an interference fit.

In some embodiment of the present disclosure, each of the first connecting elements 104 and an adjacent one of the second connecting elements 204 are jointly connected to a corresponding one of the second side plates 230, and adjacent two of the second connecting elements 204 are jointly connected to a corresponding one of the second splice plate 220. The second step body 200 may be understood as a first step of the splicing step device 10, and the first step body 100 may be understood as a second step of the splicing step device 10. When the splicing step device 10 has more step bodies, the detachable manner of two adjacent step bodies can be referred to the detachable manner between the first step body 100 and the second step body 200, which will not be repeated herein.

Any one of the second connecting elements 204 at a corner position of the splicing step device 10 may be detachably connected to a corresponding one of the second splice plates 220, as well as detachably connected to a corresponding one of the second side plates 230. Any one of the second connecting element 204 at a middle position of the splicing step device 10 may be connected to corresponding two of the second splice plates 220 and a corresponding one of the second side plates 230.

In some embodiments of the present disclosure, the second side plates 230 include three second side plates 230, the three second side plates 230 being spaced apart along a length direction of the second step body 200. The second splice plates 220 include two second splice plates 220, and the second connecting elements 204 include three second connecting elements 204. The two second splice plates 220 and the three second side plates 230 are assembled together through the three second connecting elements 204 to define two second accommodating cavities 250. Two second pedals 240 are detachably connected to the two second splice plates 220, the three second side plates 230, and the three second connecting elements 204.

The length direction of the second step body 200 can be understood as the length direction of the splicing step device 10.

Figure 14:
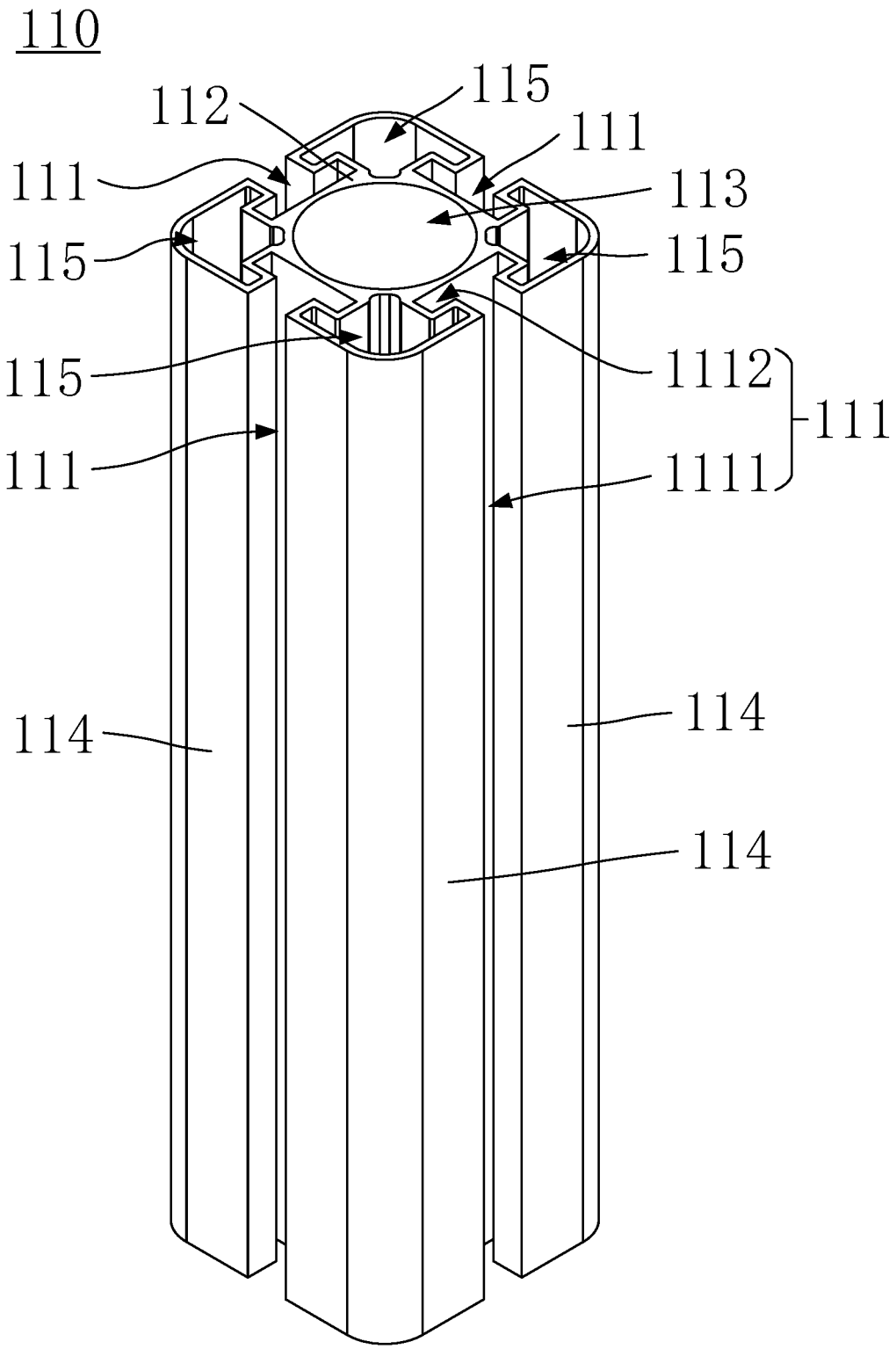
FIG. 14 is a structural schematic diagram schematic diagram of a first connecting post in the splicing step device according to one embodiment of the present disclosure.
Figure 15:
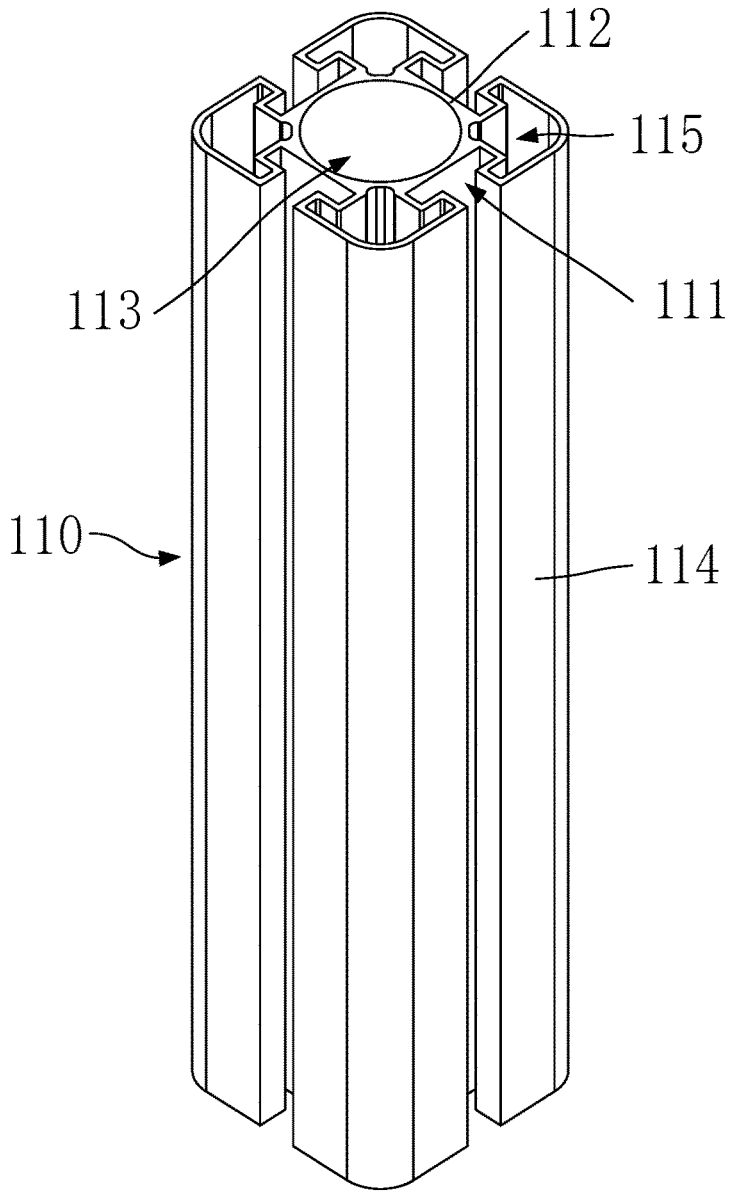
FIG. 15 is an exploded schematic diagram of a first connecting post and a support element in the splicing step device according to one embodiment of the present disclosure.
Figure 15:
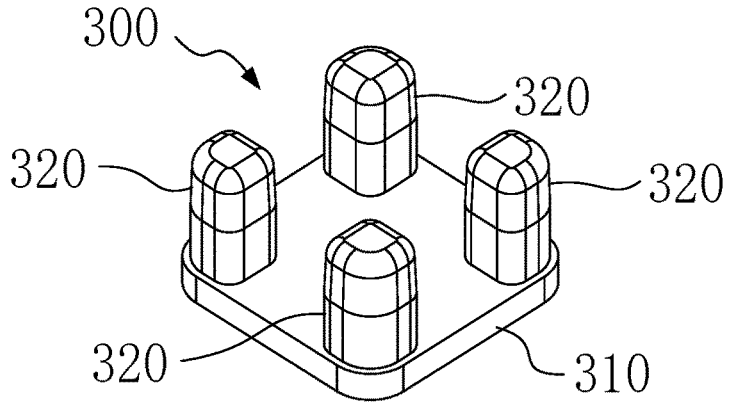
Figure 16:
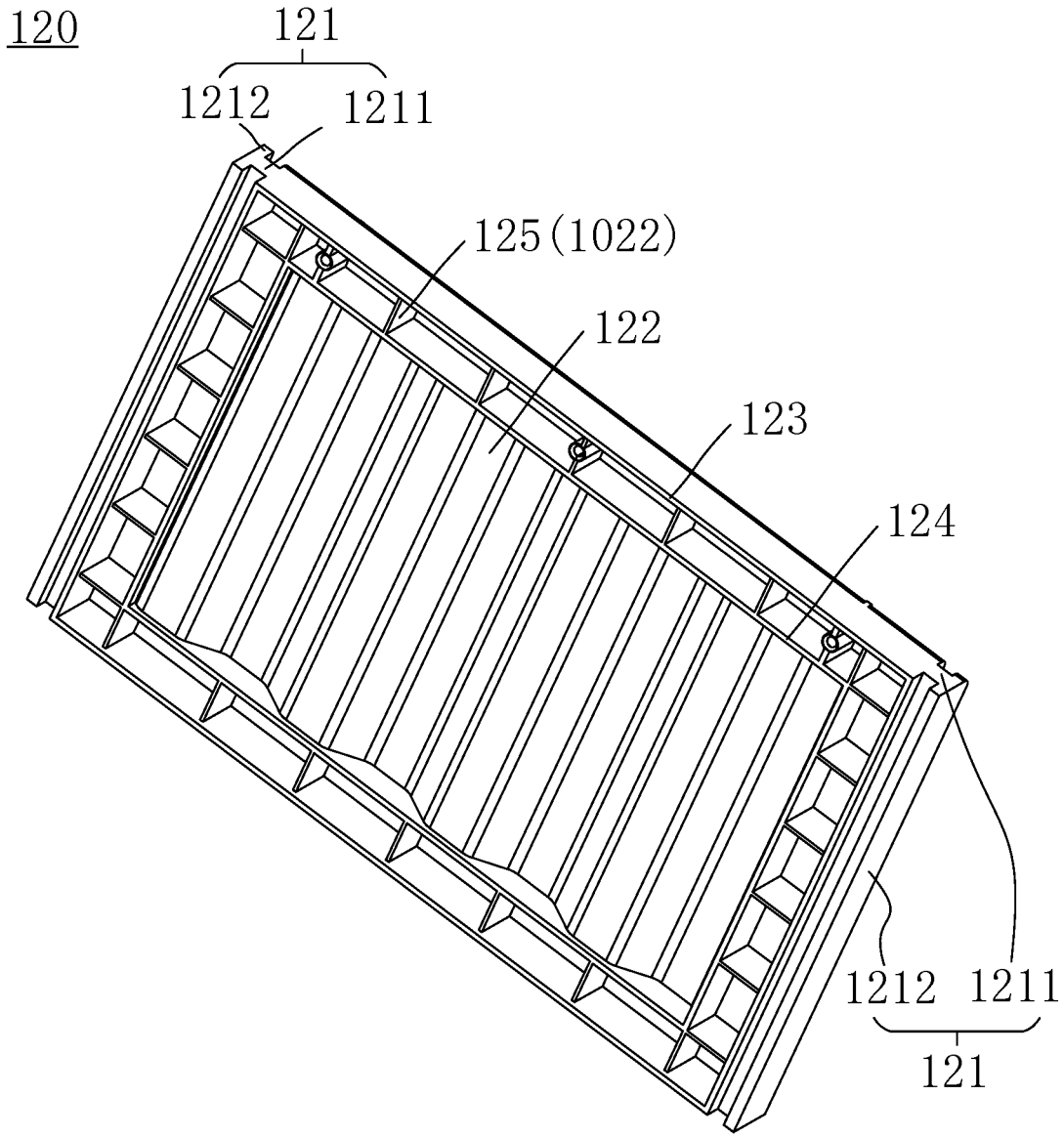
FIG. 16 is a structural schematic diagram schematic diagram of a first splice plate in the splicing step device according to one embodiment of the present disclosure.
Figure 17:
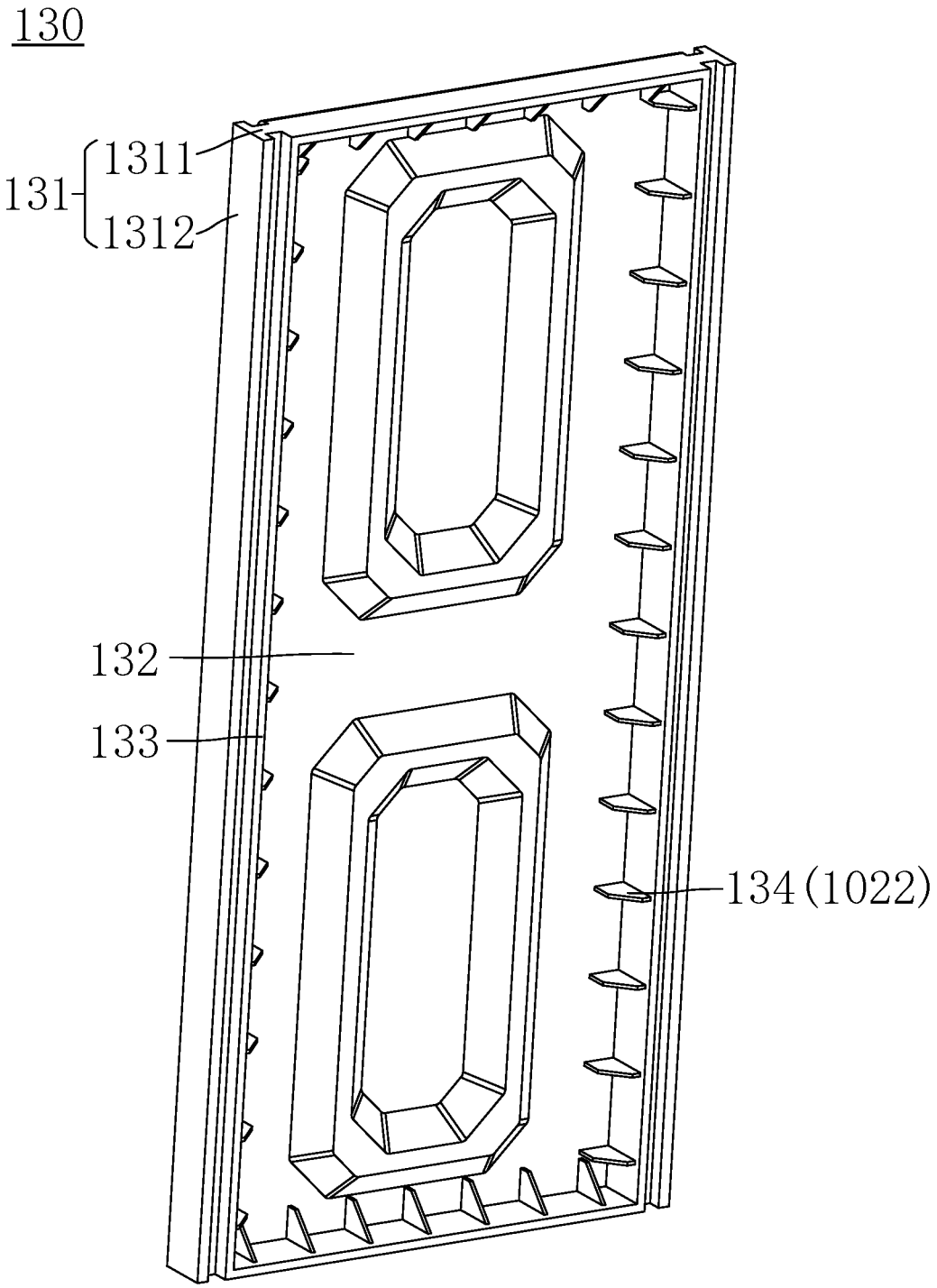
FIG. 17 is a structural schematic diagram schematic diagram of a first side plate in the splicing step device according to one embodiment of the present disclosure.
Figure 18:
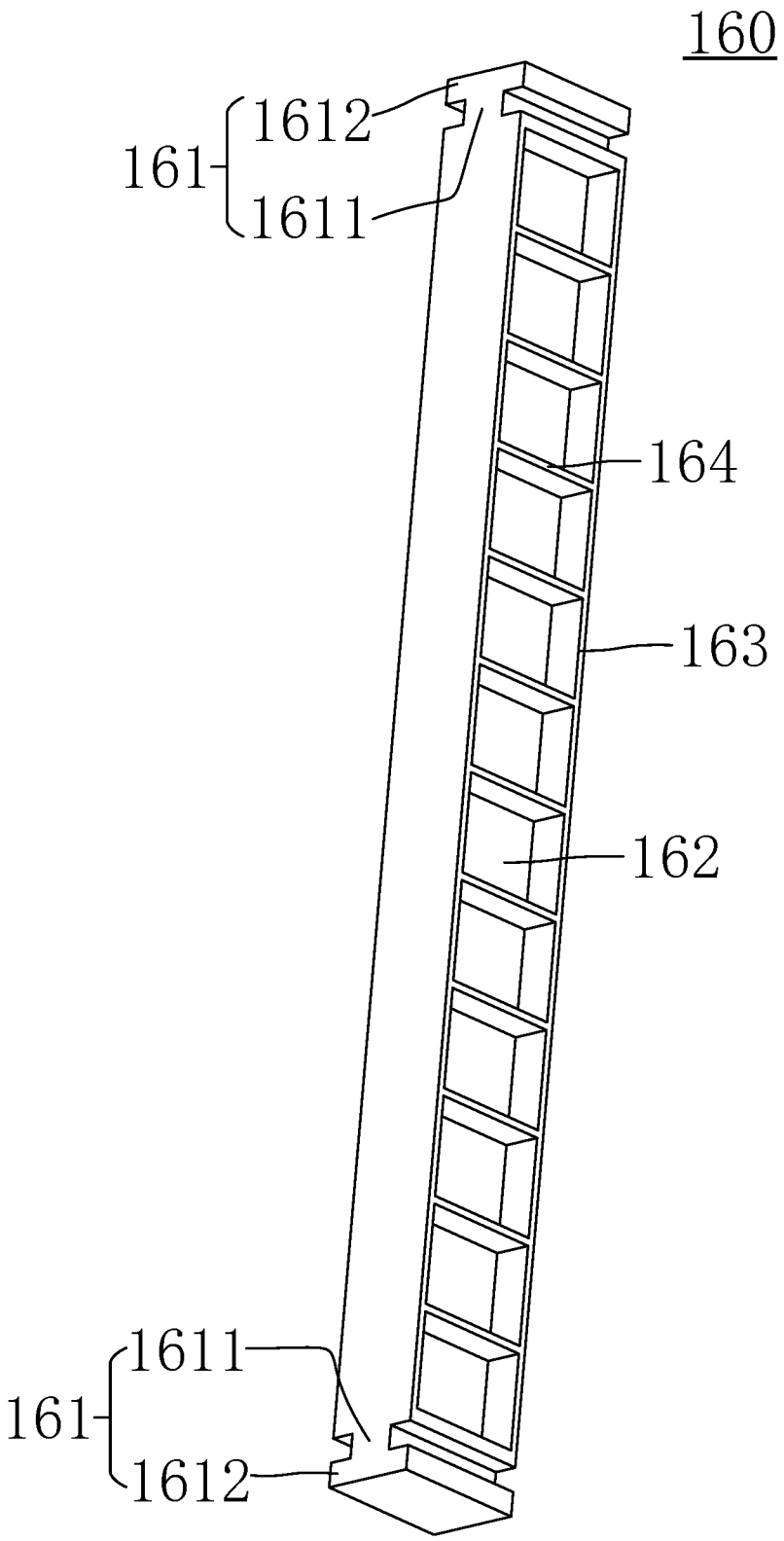
FIG. 18 is a structural schematic diagram schematic diagram of a third splice plate in the splicing step device according to one embodiment of the present disclosure.
Figure 19:
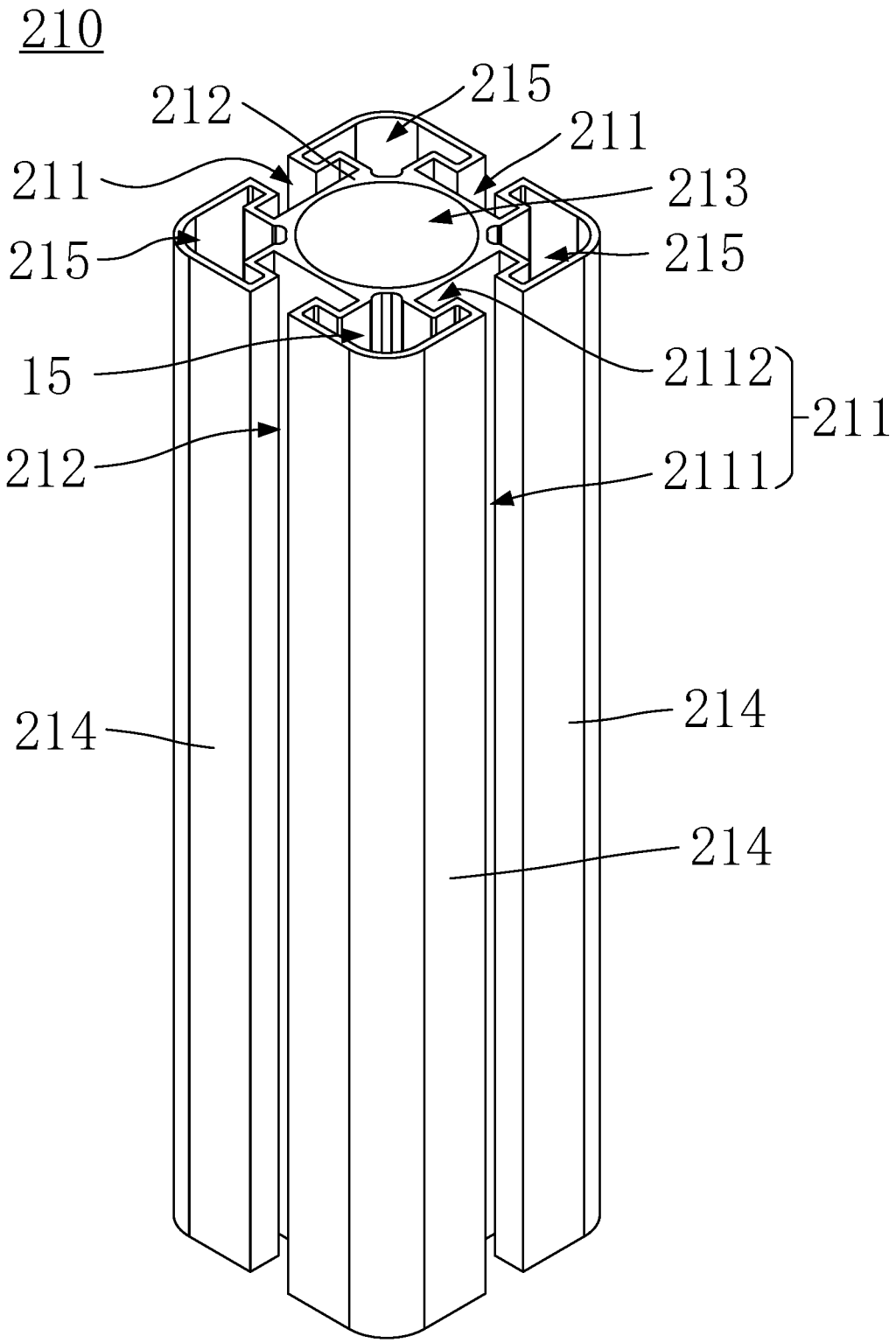
FIG. 19 is a structural schematic diagram schematic diagram of a second connecting post in the splicing step device according to one embodiment of the present disclosure.
Figure 20:
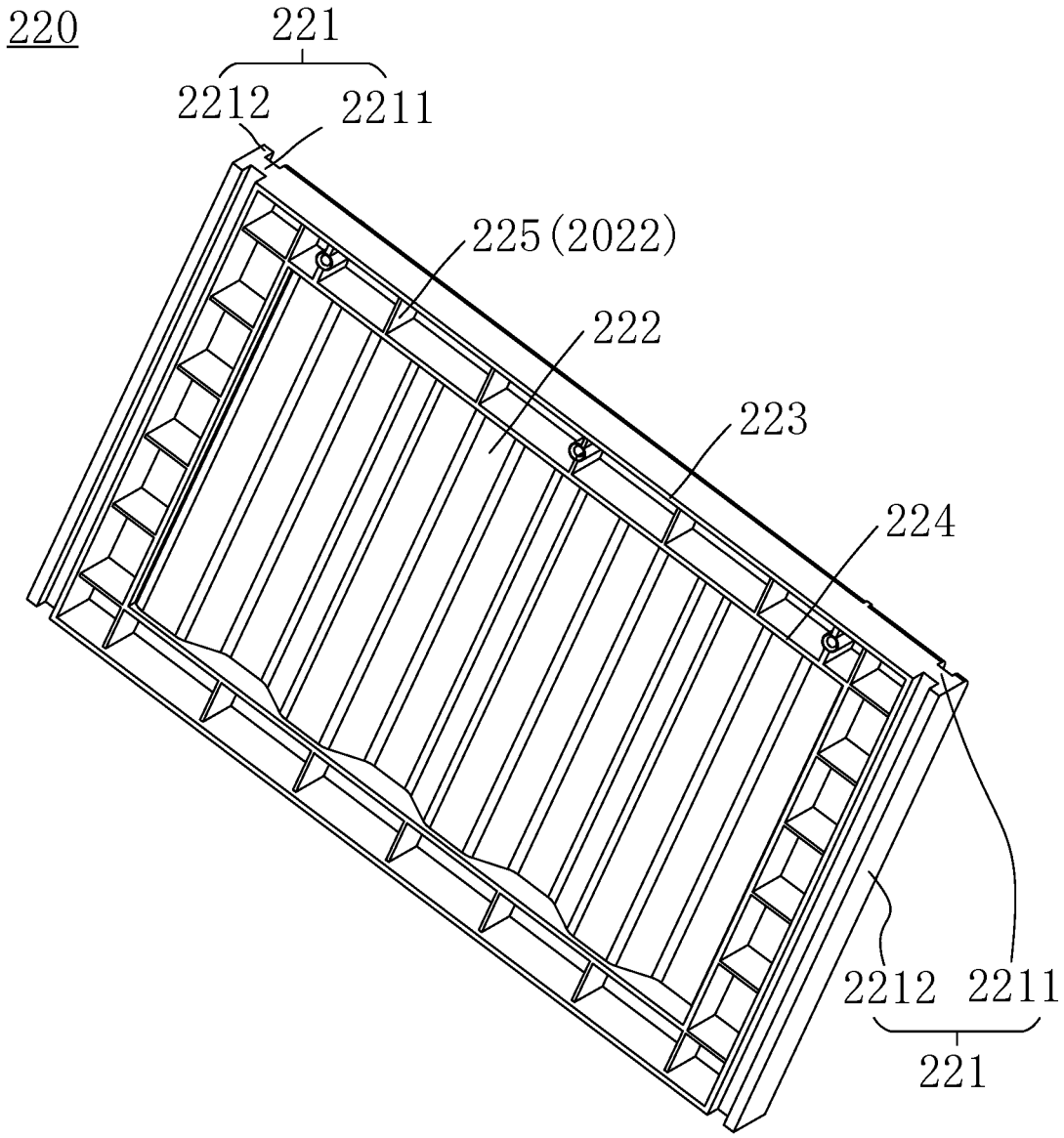
FIG. 20 is a structural schematic diagram schematic diagram of a second splice plate in the splicing step device according to one embodiment of the present disclosure.
Figure 21:
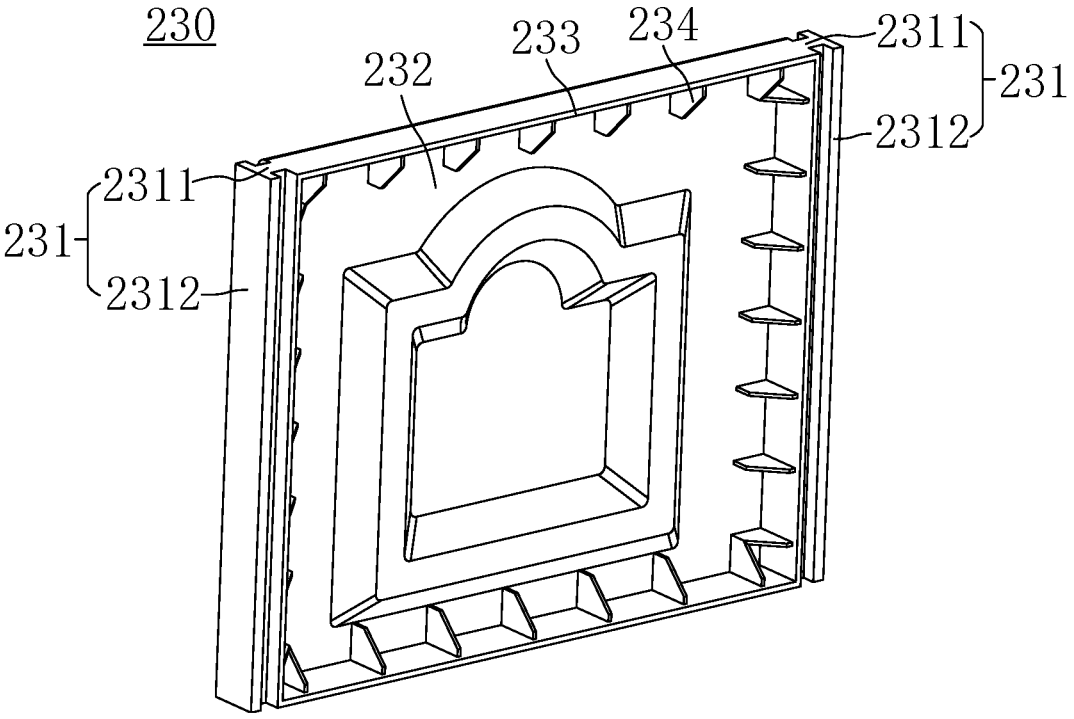
FIG. 21 is a structural schematic diagram schematic diagram of a second side plate in the splicing step device according to one embodiment of the present disclosure.

In conjunction with FIGS. 14 to 21. FIG. 14 is a structural schematic diagram schematic diagram of a first connecting post in the splicing step device according to one embodiment of the present disclosure. FIG. 15 is an exploded schematic diagram of a first connecting post and a support element in the splicing step device according to one embodiment of the present disclosure. FIG. 16 is a structural schematic diagram schematic diagram of a first splice plate in the splicing step device according to one embodiment of the present disclosure. FIG. 17 is a structural schematic diagram schematic diagram of a first side plate in the splicing step device according to one embodiment of the present disclosure. FIG. 18 is a structural schematic diagram schematic diagram of a third splice plate in the splicing step device according to one embodiment of the present disclosure. FIG. 19 is a structural schematic diagram schematic diagram of a second connecting post in the splicing step device according to one embodiment of the present disclosure. FIG. 20 is a structural schematic diagram schematic diagram of a second splice plate in the splicing step device according to one embodiment of the present disclosure, and FIG. 21 is a structural schematic diagram schematic diagram of a second side plate in the splicing step device according to one embodiment of the present disclosure.

The first connecting elements 104 are first connecting posts each 110 defining first slots 111. Each of the first plate elements 102 includes two first sliders disposed at both ends of the first plate element 102. Each of the first sliders is insertable into a corresponding one of the first slots 111 and is slidable within the corresponding one of the first slots 111. The second connecting elements 204 are second connecting posts 210 each defining second slots 211. Each of the second plate elements 202 includes two second sliders disposed at both ends thereof. Each of the second sliders is insertable into a corresponding one of the second slots 211 and is slidable within the corresponding one of the second slots 211.

Each of the first slots 111 is each of the second slots 211 are continuous. It will be appreciated that, alternatively: each of the first slots 111 and each of the second slots 211 may be discontinuous. Each of the first slots 111 and each of the second slots 211 have the same shape, each of the first slots 111 and each of the second slots 211 have substantially the same size, and each of the first slots 111 and each of the second slots 211 have different heights.

Each of the first connecting posts 110 further includes a first connecting body 112 and first connecting structures 114 disposed around the first connecting body 112. In some embodiments of the present disclosure, the number of the first slots 111 is the same as the number of the first connecting structures 114. For example, the number of the first slots 111 is four and the number of the first connecting structures 114 is four. Each of the first slots 111 is disposed between each two adjacent first connecting structures 114. Each of the first slots 111 is defined by enclosing of each two adjacent first connecting structures 114 and a corresponding first connecting body 112. The first connecting structures 114 of each of the first connecting posts 110 are disposed at four corners of each of the first connecting posts 110.

Each of the first slots 111 may include a first sliding groove 1111 and a second sliding groove 1112 communicated with the first sliding groove. Each second sliding groove 1112 thereof is closer to a corresponding first connecting body 112 compared to a corresponding first sliding groove 1111.

In some embodiments of the present disclosure, each first connecting body 112 is hollow. For example, each of the first connecting posts 110 further defines a first through hole 113 running through a corresponding first connecting body 112. Under the premise that the structural strength of each of the first connecting posts 110 is sufficient, materials are saved thus saving cost.

In some embodiments of the present disclosure, each first connecting structure 114 is hollow. For example, each of the first connecting posts 110 further includes four first limiting holes 115, and each of the first limiting holes 115 penetrating a corresponding first connecting structure 114. Under the premise that the structural strength of each of the first connecting posts 110 is sufficient, the materials are saved thus saving cost.

Each of the second connecting posts 210 further includes a second connecting body 212 and second connecting structures 214 disposed around the second connecting body 212. In some embodiments of the present disclosure, the number of the second slots 211 is the same as the number of the second connecting structures 214. For example, the number of the second slots 211 of each of the second connecting posts 210 is four and the number of the second connecting structures 214 of each of the second connecting posts 210 is four. Each of the second slots 211 is disposed between each two adjacent second connecting structures 214. Each of the second slots 211 is defined by enclosing of the two adjacent second connecting structures 214 and a corresponding second connecting body 212. The second connecting structures 214 of each of the second connecting posts 210 may be disposed at four corners of each of the second connecting posts 210.

Each of the second slots 211 includes a third sliding groove 2111 and a fourth sliding groove 2112 communicated with the third sliding groove 2111. Each fourth sliding groove 2112 is closer to a corresponding second connection body 212 than a corresponding third sliding groove 2111.

In some embodiments of the present disclosure, each second connecting body 212 is hollow. For example, each of the second connecting posts 210 further defines a second through hole 213 running through a corresponding second connecting body 212. Under the premise that the structural strength of each of the second connecting posts 210 is sufficient, the materials are saved thus saving cost.

In some embodiments of the present disclosure, each of the second connecting structures 214 is hollow. For example, each of the second connecting posts 210 further includes four second limiting holes 215, each of the second limiting holes 215 penetrating a corresponding second connecting structure 214. Under the premise that the structural strength of each of the second connecting posts 210 is sufficient, the materials are saved thus saving cost.

In some embodiments of the present disclosure, the splicing step device 10 further includes support elements 300 disposed at bottoms of the first connecting posts 110 and bottoms of the second connecting posts 210. For instance, each of the support elements 300 includes a support portion 310 and limiting portions 320 disposed on the support portion 310, the number of the limiting portion 320 being the same as the number of the first limiting holes 115 or the same as the number of second limiting holes 215, depending on whether the support elements 300 are disposed at the bottoms of the first connecting posts 110 or the bottoms of the second connecting posts 210. For example, the number of the limiting portions 320 of each of the support elements 300 is four, the number of the first limiting holes 115 of each of the first connecting posts 110 is four, and the number of the second limiting holes 215 of each of the second connecting posts 210 is four. Each of the limiting portions 320 is inserted into a corresponding first limiting hole 115 or a corresponding second limiting hole 215.

It is noted that in other embodiments of the present disclosure, each of the support elements 300 may further include a limiting block disposed between the limiting portions 320 thereof, and each limiting block may be inserted into a corresponding first through hole 113 or a corresponding second through hole 213.

In some embodiments of the present disclosure, the shape of the cross section of each of the first connecting posts 110 and the shape of the cross section of each of the second connecting posts 210 are substantially the same. That is, the shape of each of the first connecting posts 110 and the shape of each of the second connecting posts 210 are substantially the same, and a size of the cross section of each of the first connecting posts 110 and a size of the cross section of each of the second connecting posts 210 are substantially the same. The height of each of the first connecting posts 110 is greater than or substantially equal to twice the height of each of the second connecting posts 210.

In other embodiments of the present disclosure, first sliders are disposed on the first connecting posts 110 and second sliders are disposed on the second connecting posts 210, while the first slots are on the first plate elements 102 and second slots are on the second plate elements 202.

Each of the first plate elements 102 includes first reinforcing bars 1022 disposed on one side thereof and a circumference thereof. Each of the second plate elements 202 includes second reinforcing bars 2022-disposed one side and a circumference thereof. The first reinforcing bars 1022 and the second reinforcing bars 2022 are disposed within the splicing step device 10.

Each of the first splice plates 120 includes a first splice body 122, a first outer frame 123, a first inner frame 124, and two first sliders 121, where the first inner frame 124 thereof is connected to the first splice body 122 thereof, the first inner frame 124 thereof is disposed around the first splice body 122 thereof, the first outer frame 123 thereof is connected to the first inner frame 124 thereof, and the first outer frame 123 thereof is disposed around the first inner frame 124 thereof. Each of the two first sliders 121 is disposed on an outer surface of a corresponding first outer frame 123 and at an end of the corresponding first outer frame 123. Each of the two first sliders 121 is insertable into a corresponding one of the first slots 111 and is slidable within the corresponding one of the first slots 111. Each of the two first sliders 121 includes a first sliding portion 1211 and a second sliding portion 1212, where the second sliding portion 1212 thereof is disposed on an outer side of the first sliding portion 1211 thereof. Each first sliding portion 1211 is insertable into a corresponding first sliding groove 1111 and is slidable within the corresponding first sliding groove 1111. Each second sliding portion 1212 is insertable into a corresponding second sliding groove 1112 and is slidable within the corresponding second sliding groove 1112. Each second sliding portion 1212 abuts against a corresponding one of the first connecting structures 114 to limit a corresponding one of the first splice plates 120 and a corresponding one of the first connecting posts 110.

Each of the first splice plates 120 further includes first reinforcing bars 125 disposed between the first outer frame 123 thereof and the first inner frame 124 thereof, where the first reinforcing bars 125 thereof are connected to the first outer frame 123 thereof and the first inner frame 124 thereof.

In some embodiments of the present disclosure, the shape of each of the first splice plates 120 and the shape of each of the second splice plates 220 are substantially the same, the size of each of the first splice plates 120 and the size of each of the second splice plates 220 are substantially the same, the length of each of the first splice plates 120 and the length of each of the second splice plates 220 are substantially the same, the height of each of the first splice plates 120 and the height of each of the second splice plates 220 are substantially the same, and the thickness of each of the first splice plates 120 and the thickness of each of the second splice plates 220 are substantially the same. It will be appreciated that the lengths of the first splice plates 120 or the lengths of the second splice plates 220 can be understood as the length of the splice step device 10 along the length direction X. The height of each of the first splice plates 120 and the height of each of the second splice plates 220 can be understood as the height of the splice step device 10 along the height direction Z. The width of each of the first side plates 130 and the width of each of the second side plate can be understood as the width of the splicing step device 10 along the width direction Y.

Each of the first splice plates 120 and each of the second splice plates 220 may be understood as plate structures of the same type.

For instance, each of the second splice plates 220 includes a second splice body 222, a second outer frame 223, a second inner frame 224, and two second sliders 221, where the second inner frame 224 thereof is connected to the second splice body 222 thereof, the second inner frame 224 thereof is disposed around the second splice body 222 thereof, the second outer frame 223 thereof is connected to the second inner frame 224 thereof, and the second outer frame 223 thereof is disposed around the second inner frame 224 thereof. Each of the second sliders 221 is disposed on an outer surface of a corresponding second outer frame 223 and at an end of the corresponding second outer frame 223. Each of the second sliders 221 is insertable into each of the second slots 211 and is slidable within the corresponding one of the second slots 211. Each of the second sliders 221 includes a third sliding portion 2211 and a fourth sliding portion 2212, where the fourth sliding portion 2212 thereof is disposed on an outer side of the third sliding portion 2211 thereof. Each third sliding portion 2211 is insertable into a corresponding third sliding groove 2111 and is slidable within the corresponding third sliding groove 2111. Each fourth sliding portion 2212 is insertable into a corresponding fourth sliding groove 2112 and is slidable within the corresponding fourth sliding groove 2112. Each fourth sliding portion 2212 abuts against a corresponding one of the second connecting structures 214 to limit a corresponding one of the second splice plates 220 and a corresponding one of the second connecting posts 210.

Each of the second splice plates 220 further includes second reinforcing bars 225 disposed between the second outer frame 223 thereof and the second inner frame 224 thereof. The second reinforcing bars 225 each of the second splice plates 220 are connected to a corresponding second outer frame 223 and a corresponding second inner frame 224.

Each of the first side plates 130 includes a first body 132, a first frame 133, and two first sliders 131, where the first frame 133 thereof is connected to the first body 132 thereof, the first frame 133 thereof is disposed around the first body 132 thereof, each of the two first sliders 131 thereof is disposed on an outer surface of the first frame 133 thereof and at an end of the first frame 13 thereof. Each of the first sliders 131 is insertable into a corresponding one of the first slots 111 and is slidable within the corresponding one of the first slots 111. Each of the first sliders 131 includes a first sliding portion 1311 and a second sliding portion 1312, and the second sliding portion 1312 thereof is disposed on an outer side of the first sliding portion 1311 thereof. Each first sliding portion 1311 is insertable into a corresponding first sliding groove 1111 and is slidable within the corresponding first sliding groove 1111. Each second sliding portion 1312 is insertable into a corresponding second sliding groove 1112 and is slidable within the corresponding second sliding groove 1112. Each second sliding portion 1312 abuts against a corresponding one of the first connecting structures 114 to limit a corresponding one of the first side plates 130 and a corresponding one of the first connecting posts 110.

Each of the first side plates 130 further includes first reinforcing bars 134, and the first reinforcing bars 134 thereof are connected to the first frame 133 thereof and the first body 132 thereof.

In some embodiments of the present disclosure, a thickness of each of the first side plates 130 and a thickness of each of the second side plate 230 are substantially the same, and a width of each of the first side plates 130 and a width of each of the second side plate 230 are substantially the same. A height of each of the first side plates 130 is greater than or substantially equal to twice a height of each of the second side plates 230.

Each of the second side plate 230 includes a second body 232, a second frame 233, and two second sliders 231, where the second frame 233 thereof is connected to the second body 232 thereof, the second frame 233 thereof is disposed around the second body 232 thereof, each of the two second sliders 231 thereof is disposed on an outer surface of the second frame 233 thereof and at an end of the second frame 233 thereof. Each of the second sliders 231 is insertable into a corresponding one of the second slots 211 and is slidable within the corresponding one of the second slots 211. Each of the second sliders 231 includes a third sliding portion 2311 and a fourth sliding portion 2312 and the fourth sliding portion 2312 thereof is disposed on an outer side of the third sliding portion 2311 thereof. Each third sliding portion 2311 is insertable into a corresponding third sliding groove 2111 and is slidable within the corresponding third sliding groove 2111. Each fourth sliding portion 2312 is insertable into a corresponding fourth sliding groove 2112 and is slidable within the corresponding fourth sliding groove 2112. Each fourth sliding portion 2312 abuts against a corresponding one of the second connecting structures 214 to limit a corresponding one of the second side plates 230 and a corresponding one of the second connecting posts 210.

Each of the second sliders 231 can further be inserted into a corresponding one of the first slots 111 and is slidable within the corresponding one of the first slots 111. Each third sliding portion 2311 is insertable into a corresponding first sliding groove 1111 and is slidable within the corresponding first sliding groove 1111. Each fourth sliding portion 2312 is insertable into a second sliding groove 2112 and is slidable within the second sliding groove 2112. Each fourth sliding portion 2312 abuts against a corresponding one of the first connecting structure 114 to limit a corresponding one of the second side plates 230 and a corresponding one of the first connecting posts 110.

Each of the second side plate 230 further includes second reinforcing bars 234, and the second reinforcing bars 234 thereof are connected to the second frame 233 thereof and the second body 232 thereof.

In some embodiments of the present disclosure, a height of each of the first connecting posts 110 is substantially equal to twice a height of each of the second connecting posts 210, and a height of each of the first side plates 130 is substantially equal to twice height of each of the second side plates 230, such that the height of the first step body 100 is substantially equal to twice the height of the second step body 200.

In other embodiments of the present disclosure, the first step body 100 further includes third splice plates 160 detachably connected to the first connecting elements 104. Each two adjacent first connecting elements 104 are jointly connected to a corresponding one of the third splice plates 160, and each of the third splice plates 160 is disposed between two corresponding first splice plates 120. Each two adjacent first connecting elements 104 are jointly connected to the corresponding one of the third splice plates 160 and two corresponding first splice plates 120, and the two corresponding first splice plates 120 and the corresponding one of the third splice plates 160 are disposed side-by-side in the height direction of the splicing step device 10. For the connection manner between each of the third splice plates 160 and each of the first connecting elements 104 such as a corresponding first connecting post 110, reference may be made to the connection of each of the first splice plates 120 to the corresponding one of the first connecting posts 110.

For instance, each of the third splice plates 160 includes a third splice body 162, a third frame 163, and two third slides 161, where the third frame 163 thereof is connected to the third splice body 162 thereof, the third frame 163 thereof is disposed around the third splice body 162 thereof, each of the two third slides 161 is disposed on an outer surface of the third frame 163 thereof and at an end of the third frame 163 thereof. Each of the third slides 161 is insertable into a corresponding one of the first slots 111 and is slidable within the corresponding one of the first slots 111. Each of the third slides 161 includes a first sliding portion 1611 and a second sliding portion 1612, and the second sliding portion 1612 thereof is disposed on an outer side of the first sliding portion 1611 thereof. Each first sliding portion 1611 is insertable into a corresponding first sliding groove 1111 and is slidable within the corresponding first sliding groove 1111. Each second sliding portion 1612 is insertable into a corresponding second sliding groove 1112 and is slidable within the corresponding second sliding groove 1112. Each second sliding portion 1612 abuts against a corresponding one of the first connecting structures 114 to limit a corresponding one of the third splice plates 160 and a corresponding one of the first connecting posts 110.

Each of the third splice plates 160 further includes third reinforcing bars 164, and the third reinforcing bars 164 thereof are connected to the third frame 163 thereof and the third splice body 162 thereof.

In some embodiments of the present disclosure, the height of each of the first connecting posts 110 is greater than twice the height of each of the second connecting posts 210, and the height of each of the first side plates 130 is greater than twice the height of each of the second side plate 230. The thickness of each of the second pedals 240 is substantially equal to the height of each of the third splice plates 160. The height of each of the first connecting posts 110 is substantially equal to a sum of twice the height of each of the second connecting posts 210 and the height of each of the third splice plates 160. The height of each of the first side plates 130 is substantially equal to a sum of twice the height of each of the second side plate 230 and the height of each of the third splice plates 160. Thereby: the height of the first step body 100 is substantially equal to twice the height of the second step body 200.

The first connecting posts 110 and the second connecting posts 210 of the embodiments of the present disclosure are provided in a regular manner, the first slots 111 of each of the first connecting posts 110 are disposed at equal intervals and uniformly distributed, and the second slots 211 of each of the second connecting posts 210 are disposed at equal intervals and uniformly distributed. In this way: when the first plate elements 102, the second plate elements 202, the first connecting posts 110, and the second connecting posts 210 are assembled, any of the first plate elements 102 and the second plate elements 202 is insertable into any of the first slots 111 of each of the first connecting posts 110, and any of the second plate elements 202 is insertable into any of the second slots 211 of each of the second connecting posts 210. Thus, the embodiments of the present disclosure facilitate the user to assemble and disassemble the first plate elements 102, the second plate elements 202, the first connecting posts 110, and the second connecting posts 210. Moreover, the first connecting posts 110 and the second connecting posts 210 are column structures, such that the first connecting posts 110 and the second connecting posts 210 not only serve to assemble/disassemble the first plate elements 102 and the second plate elements 202, but also play a supporting role, which further increase the overall stability of the splicing step device 10, such that the splicing step device 10 is subjected to uniform force.

It should be noted that the first connecting elements 104 are not limited to the first connecting posts 110, and the second connecting elements 204 are not limited to the second connecting posts 210. The first connecting elements 104 and the second connecting elements 204 may be the column structures having other shapes, or the first connecting elements 104 and the second connecting elements 204 may be other connecting components. For example, at least two of the first connecting elements 104 are connected to adjacent two of first plate elements 102, at least two of the second connecting elements 204 are connected to adjacent two of the second plate elements 202, and at least two of the first connecting elements 104 are connected to one of the first plate elements 102 and one of the second plate elements 202 that are adjacent to each other. The adjacent two of the first plate elements 102 may be connected by a limiting structure including a limiting groove and a limiting portion, where the limiting groove thereof is disposed in a first one of the adjacent two of the first plate elements 102, and the limiting portion thereof is disposed in a second one of the adjacent two of the first plate elements 102.

Description is provided below in conjunction with the accompanying drawings.

Figure 22:
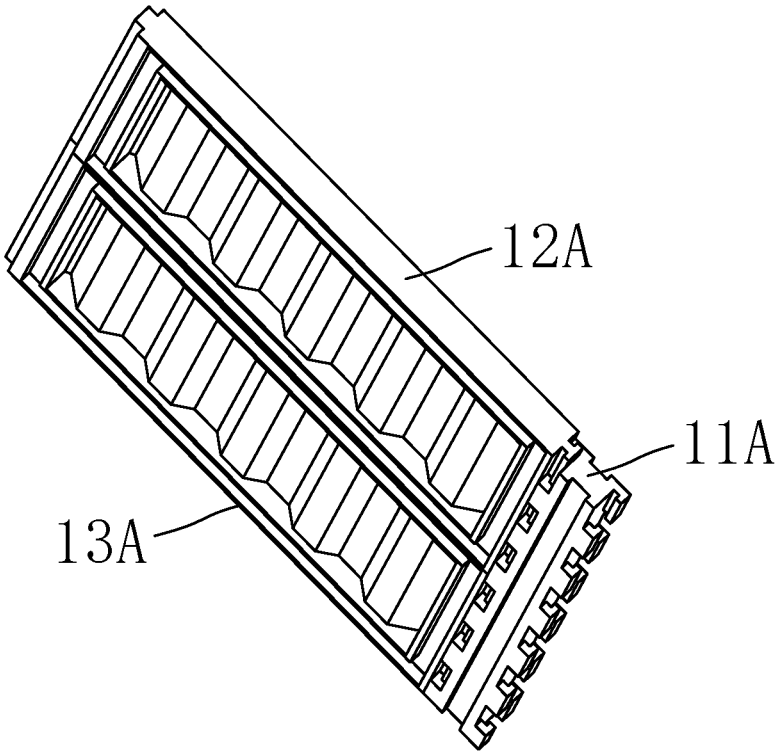
FIG. 22 is a schematic diagram schematic diagram of a way of connecting two plate elements and a connecting element in the splicing step device according to one embodiment of the present disclosure.
Figure 23:
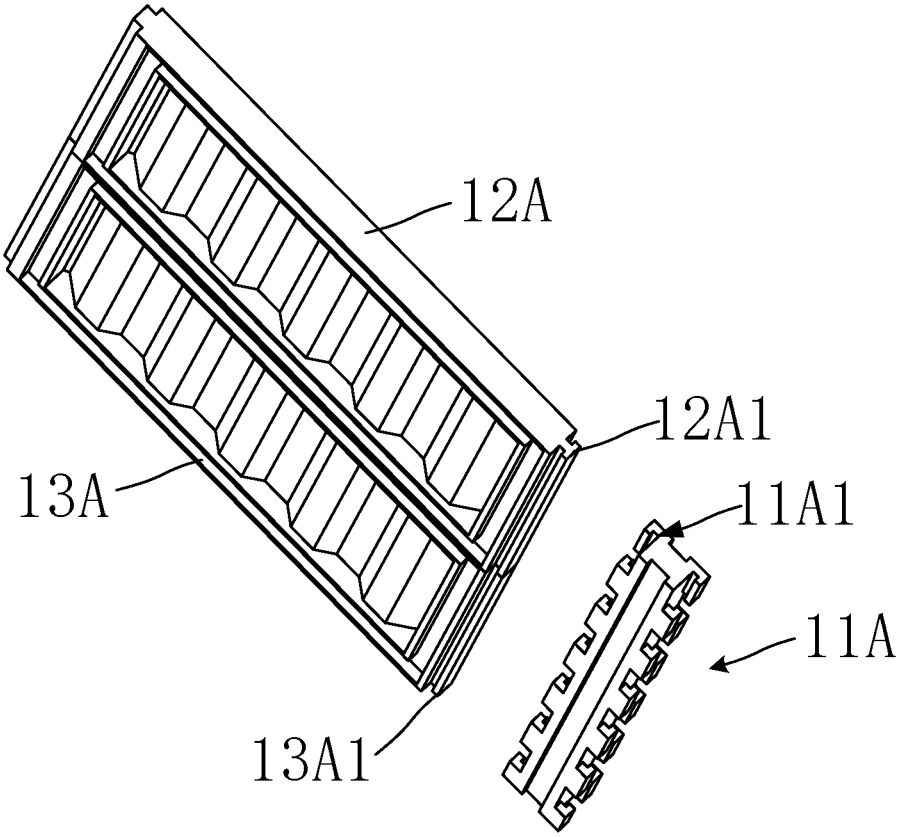
FIG. 23 is an exploded schematic diagram of the way of connecting the two plate elements and the connecting element as shown in FIG. 22.

In conjunction with FIGS. 22 and 23, FIG. 22 is a schematic diagram schematic diagram of a way of connecting two plate elements and a connecting element in the splicing step device according to one embodiment of the present disclosure, and FIG. 23 is an exploded schematic diagram of the way of connecting the two plate elements and the connecting element as shown in FIG. 22.

The splicing step device 10 includes a first plate 12A, a second plate 13A, and a connecting rod 11A (i.e., the at least two of the plate elements and at least one of the connecting element). The connecting rod 11A defines two slots 11A1 that are discontinuous, and each of the two slots 11A1 is disposed on a side of the connecting rod 11A. One of the two slots 11A1 is connected to the first plate 12A and the second plate 13A, the first plate 12A and the second plate 13A are disposed on the same side of the connecting rod 11A, and the first plate 12A and the second plate 13A may be disposed side by side. The first plate 12A includes at least one slider 12A1, where the at least one slider 12A1 is insertable into the one of the slot 11A1 and is slidable within the one of the slot 11A1. The second plate 13A includes at least one slider 13A1, where the at least one slider 13A1 is insertable into the one of the slots 11A1 and is slidable within the one of the slot 11A1.

Structures of the at least one slider 12A1 and the at least one slider 13A1 may be referenced to each of the first sliders 121, each of the first sliders 131, each of the second sliders 221, or each of the second sliders 231, which are not described herein.

The first plate element 102 or the second plate element 202 includes the first plate 12A and the second plate 13A. Each of the first connecting elements 104 or the second connecting element 204 includes the connecting rod 11A.

The discontinuous slots 11A1 each defines clamping slots, and the slots 11A1 called as clamping slots.

Figure 24:
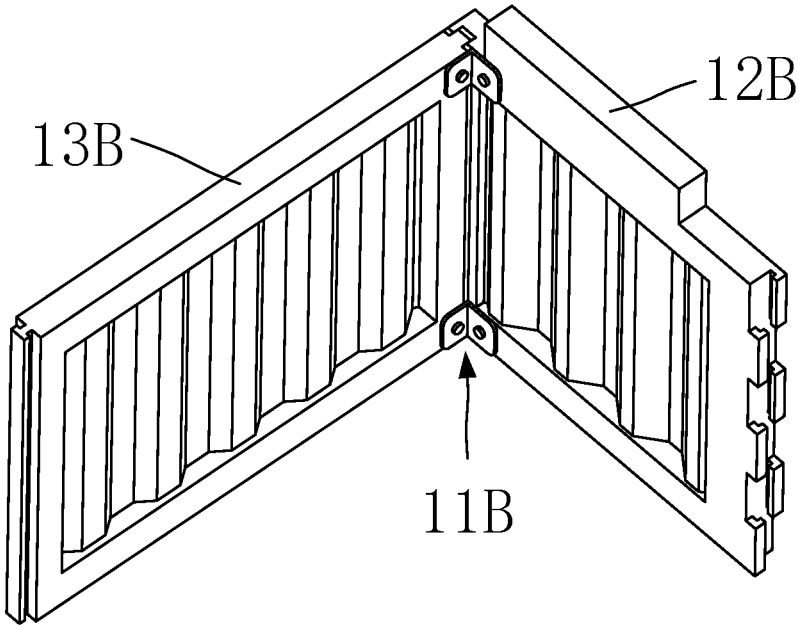
FIG. 24 is a schematic diagram schematic diagram of another way of connecting two plate elements and a connecting element in the splicing step device according to one embodiment of the present disclosure.
Figure 25:
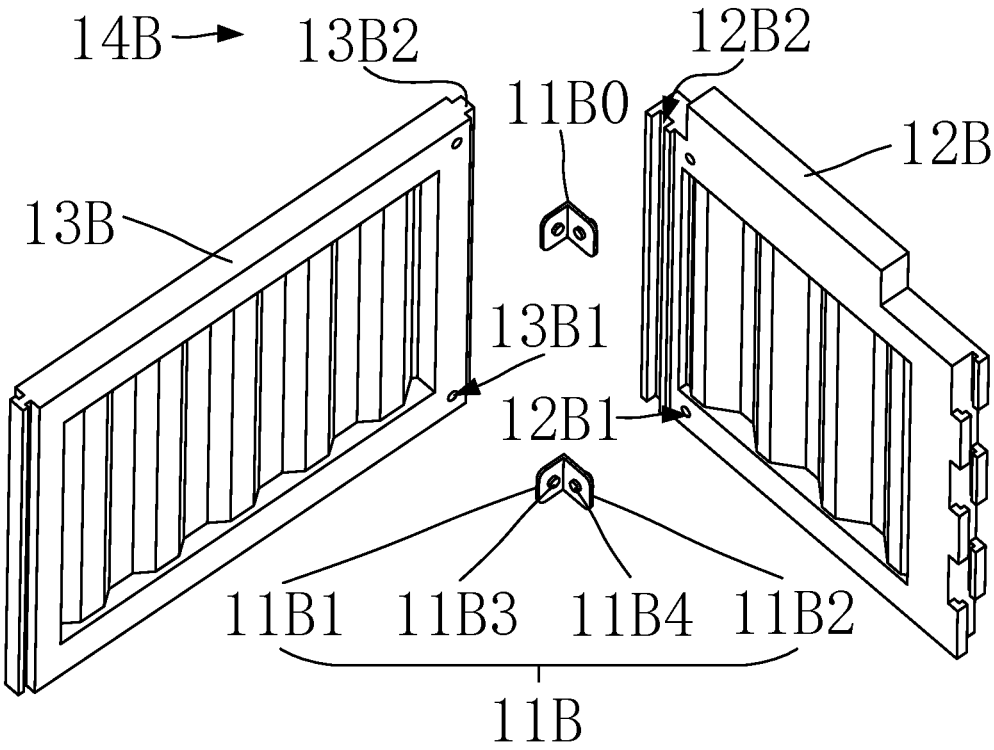
FIG. 25 is an exploded schematic diagram of another way of connecting the two plate elements and the connecting element shown in FIG. 24.

In conjunction with FIG. 24 and FIG. 25, FIG. 24 is a schematic diagram schematic diagram of another way of connecting two plate elements and a connecting element in the splicing step device according to one embodiment of the present disclosure, and FIG. 25 is an exploded schematic diagram of another way of connecting the two plate elements and the connecting element shown in FIG. 24.

The splicing step device 10 includes a first plate 12B, a second plate 13B, and at least two connecting assemblies 11B (i.e., the at least two of the plate elements and at least one of the connecting element). Each of the first connecting elements 104 and/or the second connecting element 204 may refer to the connecting assemblies 11B, and each of the first plate elements 102 and/or each of the second plate elements 202 refer to the first plate 12B and the second plate 13B.

For instance, the connecting assemblies 11B include corner connectors 11B0. The corner connector 11B0 include first corner connector portions 11B1 and second corner connector portions 11B2. The first corner connector portions 11B1 are connected to the first plate 12B, and the second corner connector portions 11B2 are connected to the second plate 13B. Each of the first corner connector portions 11B1 and a corresponding one of the second corner connector portions 11B2*s* are fixedly connected such as being integrally disposed, and each of the first corner connector portion 11B1 and the corresponding one of the second corner connector portion 11B2 are bent to each other such as perpendicular to each other.

The connecting assemblies 11B further includes first screws 11B3 and second screws 11B4, the first screws 11B3 respectively pass through the first corner connector portions 11B1 to be fixedly connected to the first plate 12B, and the second screws 11B4 respectively pass through the second corner connector portions 11B2 to be fixedly connected to the second plate 13B. Correspondingly: the first plate 12B defines at least two first screw holes 12B1, and the second plate 13B defines at least two second screw holes 13B1. Each of the first screws 11B3 is insertable into or screwed to a corresponding one of the first screw holes 12B1, and each of the second screws 11B4 is insertable into or screwed to a corresponding one of the second screw holes 13B1.

The number of the connecting assemblies 11B is two, the number of the first screw holes 12B1 is two, and the number of the second screw holes 13B1 is two. In this way: the two connecting assemblies 11B are respectively connected at two corners of the first plate 12B and the second plate 13B.

In order to increase the connection stability between the first plate 12B and the second plate 13B, in some embodiments of the present disclosure, the first plate 12B and the second plate 13B are further connected by a limiting structure 14B. The limiting structure includes a limiting groove such as a limiting groove 12B2 disposed on the first plate 12B, and a limiting portion such as a limiting portion 13B2 disposed on the second plate 13B. The limiting portion 13B2 is insertable into the limiting groove 12B2. It will be appreciated that it is also possible that the limiting groove of the limiting structure 14B is disposed on the second plate 13B, and the limiting portion of each limiting structure 14B is disposed on the first plate 12B.

Figure 26:
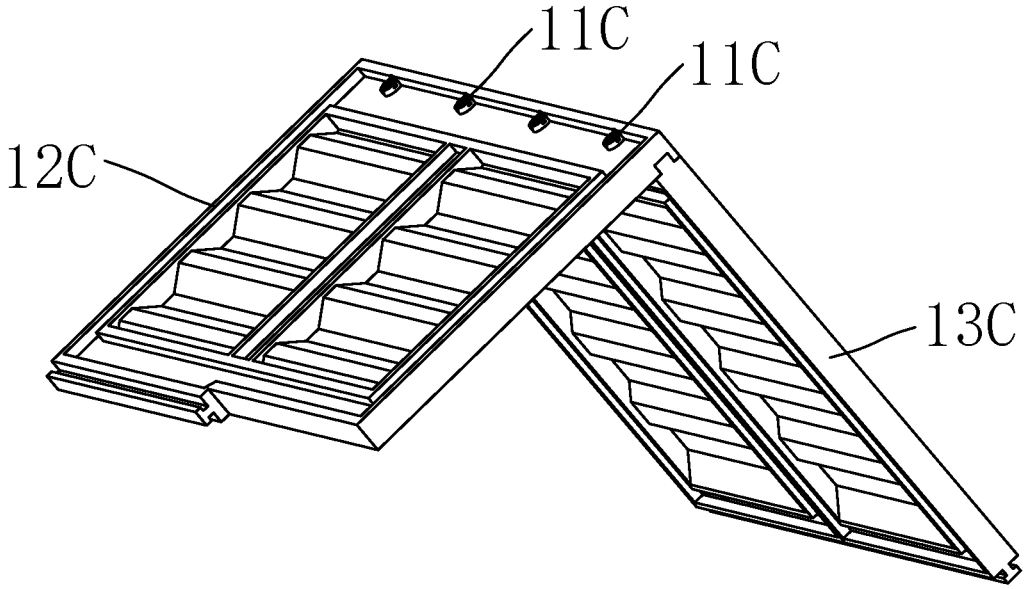
FIG. 26 is a schematic diagram schematic diagram of further another way of connecting two plate elements and a connecting element in the splicing step device according to one embodiment of the present disclosure.
Figure 27:
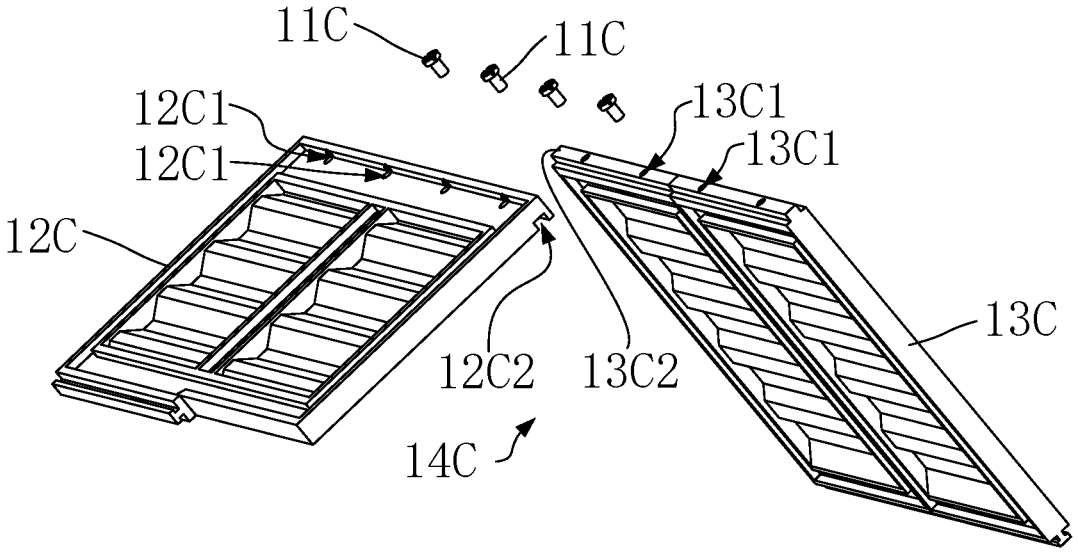
FIG. 27 is an exploded schematic diagram of further another way of connecting the two plate elements and the connecting element shown in FIG. 26.

FIG. 26 is a schematic diagram schematic diagram of further another way of connecting two plate elements and a connecting element in the splicing step device according to one embodiment of the present disclosure, and FIG. 27 is an exploded schematic diagram of further another way of connecting the two plate elements and the connecting element shown in FIG. 26.

The splicing step device 10 includes a first plate 12C, a second plate 13C, and at least two connecting elements 11C (i.e., the at least two of the plate elements and at least one of the connecting element). Each of the first connecting elements 104 and/or each of the second connecting elements 204 may refer to the connecting elements 11C, and each of the first plate elements 102 and/or each of the second plate elements 202 may refer to the first plate 12C and the second plate 13C.

For instance, the connecting elements 11C are screws 11C connected to the first plate 12C and the second plate 13C. The screws 11C can penetrate one of the first plate 12C and the second plate 13C. For example, the screws 11C can penetrate the first plate 12C to be connected to the second plate 13C.

The first plate 12C includes first screw holes 12C1 penetrating the first plate 12C, and the second plate 13C includes second screw holes 13C1 that do not penetrate the second plate 13C. The screws 11C respectively penetrate through the first screw holes 12C1 and are inserted into, or screwed to, the second screw holes 13C1. The number of the screws 11C of the embodiments of the present disclosure is taken to be four as an example, with the four screws 11C being disposed in an equidistant spacing. It will be appreciated that the number of the screws 11C is not limited to four, such as three, five, six, etc.

In order to increase the connection stability between the first plate 12C and the second plate 13C, in some embodiments of the present disclosure, the first plate 12C and the second plate 13C are further connected by a limiting structure 14C. The limiting structure 14C includes a limiting groove such as a limiting groove 12C2 disposed on the first plate 12C, and a limiting portion such as a limiting portion 13C2 disposed on the second plate 13C. The limiting portions 13C2 is insertable into the limiting groove 12C2. It will be appreciated that it is also possible that the limiting groove of the limiting structure 14C is disposed on the second plate 13C, and the limiting portions of the limiting structure 14C is disposed on the first plate 12C.

It is also to be noted that the first plate elements 102 and the second plate elements 202 may alternatively be detachably connected without additional connecting elements. Instead, the detachability of the first plate elements 102 and the second plate elements 202 can be realized by: for example, a way where each two adjacent first plate elements 102 may be directly disassembled or assembled, each of the first plate elements 102 and the corresponding one of the second plate elements 202 may be directly assembled or disassembled, and two adjacent second plate elements 202 may be directly collocated or disassembled.

For instance, a slot is defined on a first end of each of the first plate elements 102 and a slider is disposed on a second end of each of ach of the first plate elements 102, a slot is defined on a first end of each of the second plate elements 202 and a slider is disposed on a second end of each of ach of the second plate elements 202

Figure 28:
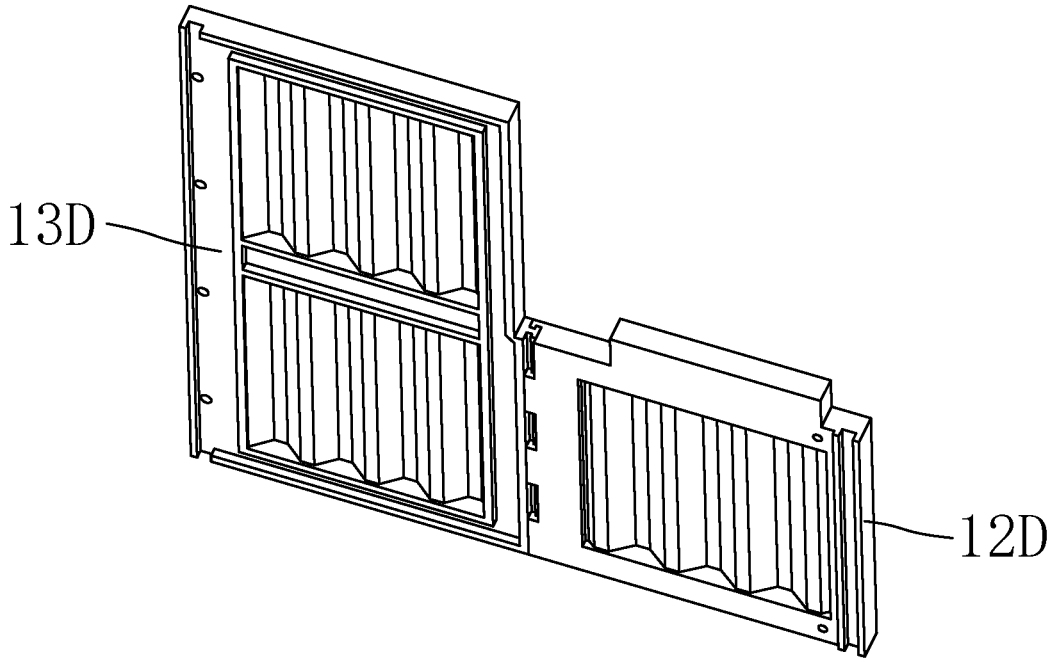
FIG. 28 is a schematic diagram schematic diagram of further another way of connecting two plate elements in the splicing step device according to one embodiment of the present disclosure.
Figure 29:
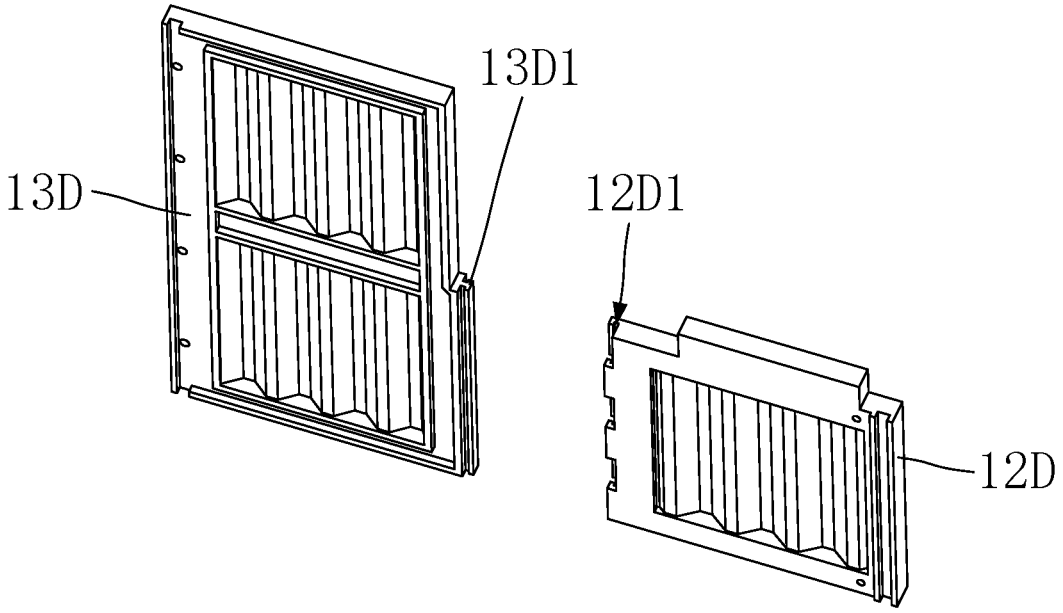
FIG. 29 is an exploded schematic diagram of further another way of connecting the two plate elements shown in FIG. 28.

FIG. 28 is a schematic diagram schematic diagram of further another way of connecting two plate elements in the splicing step device according to one embodiment of the present disclosure, and FIG. 29 is an exploded schematic diagram of further another way of connecting the two plate elements shown in FIG. 28.

The splicing step device 10 includes a first plate 12D and a second plate 13D, and the first plate 12D and the second plate 13D can be directly assembled or directly disassembled. The first plate 12D includes at least one slot 12D1, and the at least one slot 12D1 may refer to the slot 11A1 and may also refer to each of the first slots 111 and each of the second slots 211, which will not be repeated herein. The second plate 13D includes at least one slider 13D1, the at least one slider 13D1 may refer to the at least one slider 12A1 and may also refer to each of the first sliders 121, each of the second sliders 221, each of the first sliders 131, and each of the second sliders 231, which will not be described herein. The at least one slider 13D1 may be inserted into the at least one slot 12D1 and is slidable within the at least one slot 12D1. In this way, the first plate 12D and the second plate 13D are directly splicable or directly detachable.

Each of the first plate elements 102 and/or each of the second plate elements 202 may include the first plate 12D and the second plate 13D.

It should be noted that the various portions of the splicing step device 10 defined by the embodiments of the present disclosure are subject to machining errors during the actual machining process. Substantially equal or substantially the same or of the same model number of two or two types of components in the splicing step device 10 defined by the embodiments of the present disclosure may be understood as both being substantially equal or substantially identical or of the same model number within an error range.

The splicing step device provided by the embodiments of the present disclosure is described in detail above, specific examples are applied herein to illustrate the principles and implementations of the present disclosure, and the illustrations of the above embodiments are only intended to assist in the understanding of the method of the present disclosure and its core ideas. In addition, for those skilled in the art, based on the ideas of the present disclosure, there will be changes in the specific implementations and the scope of the application, which will not be construed as an interpretation of the contents of the present specification. In summary, the contents of this specification should not be construed as a limitation of the present disclosure.

What is claimed is:

1. A splicing step device, comprising a first step body and a second step body; wherein a height of the first step body is different from a height of the second step body; the first step body is configured by splicing;

wherein the first step body comprises first plate elements and first connecting elements; the first plate elements and the first connecting elements are detachably connected to assemble the first step body;

wherein the first plate elements comprise first splice plates and first side plates, the first splice plates being disposed at front and rear sides of the first side plates; each of the first connecting elements is connected to at least one of the first splice plates and at least one of the first side plates;

each of the first splice plates is detachably connected to two of the first connecting elements;

each of the first side plates is detachably connected to two of the first connecting elements;

wherein a height of the first step body is greater than a height of the second step body, and the first step body and the second step body are configured by splicing;

the second step body comprises second plate elements and second connecting elements, the second plate elements and the second connecting elements being detachably connected to splice up the second step body; the second plate elements comprises second splice plates and second side plates, the second splice plates and the first splice plates being disposed on front and rear sides of the second side plates; each of the second connecting elements is connected to at least one of the second splice plates and at least one of the second side plates;

each of the second splice plates is detachably connected to two of the second connecting elements;

each of the second side plates is detachably connected to one of the first connecting elements and one of the second connecting elements;

wherein a shape of each of the first splice plates and a shape of each of the second splice plates are substantially the same;

a size of each of the first splice plates and a size of each of the second splice plates are substantially the same; and a width of each of the first side plates and a width of each of the second side plates are substantially equal, and a height of each of the first side plates is greater than or substantially equal to twice height of each of the second side plates.

2. The splicing step device according to claim 1, wherein the first side plates and the first splice plates are assembled together through the first connecting elements to define one or more first accommodating cavities;

the first step body further comprises one or more first pedals; wherein the one or more first pedals are detachably connected to the first splice plates, the first side plates, and the first connecting elements; each of the first pedals covers on a corresponding first accommodating cavity.

3. The splicing step device according to claim 1, wherein each of the first side plates is connected between adjacent two of the first connecting elements;

the adjacent two of the first connecting elements are jointly connected to corresponding two of the first side plates, and the corresponding two of the first side plates are disposed side by side along a height direction of the splicing step device.

4. The splicing step device according to claim 3, wherein three first side plates are provided, and the three first side plates are spaced apart along a length direction of the first step body;

eight first splice plates are provided, and six first connecting elements are provided;

the first splice plates and the first side plates are assembled together through the first connecting elements to define two first accommodating cavities, the first step body further comprises two first pedals; wherein the two first pedals are detachably connected to the eight first splice plates, the three first side plates, and the six first connecting elements; the two first pedals respectively covers on the two first accommodating cavities.

5. The splicing step device according to claim 1, wherein the first connecting elements are first connecting posts each defining first slots; each of the first plate elements comprises two first sliders, and the two first sliders of each of the first plate elements are disposed at both ends of each of the first plate elements; each of the first sliders is insertable into a corresponding one of the first slots and is slidable within the corresponding one of the first slots.

6. The splicing step device according to claim 5, wherein each of the first slots is continuous or defines at least one notch.

7. The splicing step device according to claim 5, wherein four first slots are defined on each of the first connecting elements, and the four first slots of each of the first connecting posts are evenly disposed on four sides of each of the first connecting posts;

each of the first connecting posts further comprises a first connecting body and four first connecting structures disposed around the first connecting body; each of the first slots is disposed between corresponding adjacent two first connecting structures; the four first connecting structures of each of the first connecting posts are disposed at four corners of each of the first connecting posts;

each first connecting body is hollow, and each first connecting structure is hollow.

8. The splicing step device according to claim 1, wherein adjacent two of the first plate elements are connected to at least two of the first connecting elements;

each of the first connecting elements comprises a screw or a corner connector.

9. The splicing step device according to claim 8, wherein the adjacent two of the first plate elements are connected through a limiting structure; each limiting structure comprises a limiting groove and a limiting portion; the limiting groove is disposed in a first one of the adjacent two of the first plate elements, and each of the limiting portions is disposed in a second one of the adjacent two of the first plate elements.

10. The splicing step device according to claim 1, wherein the first step body comprises first plate elements; the first plate elements are capable of being directly assembled to assemble the first step body; and a first end of each of the first plate elements defines a slot, and a slide is disposed on a second end of each of the first plate elements.

11. The splicing step device according to claim 1, wherein a height of the first step body is greater than a height of the second step body, and the first step body and the second step body are splicable;

the height of the first step body is substantially twice the height of the second step body.

12. The splicing step device according to claim 1, wherein a height of the first step body is greater than a height of the second step body, and the first step body and the second step body are configured by splicing;

the second step body comprises second plate elements and second connecting elements, the second plate elements and the second connecting elements being detachably connected to assemble the second step body;

the second plate elements and the first connecting elements are detachably connected to assemble the first step body and the second step body.

13. The splicing step device according to claim 12, wherein the first connecting elements are first connecting posts defining first slots; each of the first plate elements comprises two first sliders respectively disposed at both ends of each of the first plate elements; each of the first sliders is insertable into a corresponding one of the first slots and is slidable within the corresponding one of the first slots;

the second connecting elements are second connecting posts each defining second slots; each of the second plate elements comprises two second sliders, and the two second sliders of each of the second plate elements are disposed at both ends of each of the second plate elements; each of the second sliders is insertable into a corresponding one of the second slots and is slidable within the corresponding one of the second slots.

14. The splicing step device according to claim 13, wherein a shape of a cross section of each of the first connecting posts and a shape of a cross section of each of the second connecting posts are substantially the same;

a height of each of the first connecting posts is greater than or substantially equal to twice a height of each of the second connecting posts.

15. The splicing step device according to claim 13, wherein each of the first plate elements comprises first reinforcing bars disposed on a side thereof and on a circumference thereof;

each of the second plate elements comprises second reinforcing bars disposed on one side thereof and on a circumference thereof;

the first reinforcing bars and the second reinforcing bars are disposed within the splicing step device.

16. The splicing step device according to claim 1, wherein adjacent two of the first connecting elements are jointly connected to a corresponding one of the first side plates;

the first step body further comprises third splice plates detachably connected to the first connecting elements; adjacent two of the first connecting elements are jointly connected to a corresponding one of the third splice plates, and each of the third splice plates is disposed between corresponding two of the first splice plates;

adjacent two of the first connecting elements are jointly connected to a corresponding one of the third splice plates and corresponding two of the first splice plates, and the corresponding two of the first side plates and the corresponding one of the third splice plates are disposed side-by-side along a height direction of the splicing step device;

the second side plates and the second splice plates are assembled together through the second connecting elements to define one or more second accommodating cavities;

the second step body further comprises one or more second pedals; wherein the one or more second pedals are detachably connected to the second splice plates, the second side plates, and the second connecting elements; each of the second pedals covers on a corresponding second accommodating cavity; and a thickness of each of the second pedals is substantially equal to a height of each of the third splice plates.

17. A splicing step device, comprising a first step body and a second step body; wherein a height of the first step body is different from a height of the second step body; the first step body is configured by splicing;

wherein the first step body comprises first plate elements and first connecting elements; the first plate elements and the first connecting elements are detachably connected to assemble the first step body;

wherein a height of the first step body is greater than a height of the second step body, and the first step body and the second step body are configured by splicing;

the second step body comprises second plate elements and second connecting elements, the second plate elements and the second connecting elements being detachably connected to assemble the second step body;

the second plate elements and the first connecting elements are detachably connected to assemble the first step body and the second step body;

wherein the first connecting elements are first connecting posts defining first slots; each of the first plate elements comprises two first sliders respectively disposed at both ends of each of the first plate elements; each of the first sliders is insertable into a corresponding one of the first slots and is slidable within the corresponding one of the first slots;

the second connecting elements are second connecting posts each defining second slots; each of the second plate elements comprises two second sliders, and the two second sliders of each of the second plate elements are disposed at both ends of each of the second plate elements; each of the second sliders is insertable into a corresponding one of the second slots and is slidable within the corresponding one of the second slots;

wherein each of the first plate elements comprises first reinforcing bars disposed on a side thereof and on a circumference thereof;

each of the second plate elements comprises second reinforcing bars disposed on one side thereof and on a circumference thereof; and the first reinforcing bars and the second reinforcing bars are disposed within the splicing step device.

18. A splicing step device, comprising a first step body and a second step body; wherein a height of the first step body is different from a height of the second step body; the first step body is configured by splicing;

wherein the first step body comprises first plate elements and first connecting elements; the first plate elements and the first connecting elements are detachably connected to assemble the first step body;

wherein the first plate elements comprise first splice plates and first side plates, the first splice plates being disposed at front and rear sides of the first side plates; each of the first connecting elements is connected to at least one of the first splice plates and at least one of the first side plates;

each of the first splice plates is detachably connected to two of the first connecting elements;

each of the first side plates is detachably connected to two of the first connecting elements;

wherein a height of the first step body is greater than a height of the second step body, and the first step body and the second step body are configured by splicing;

the second step body comprises second plate elements and second connecting elements, the second plate elements and the second connecting elements being detachably connected to splice up the second step body; the second plate elements comprises second splice plates and second side plates, the second splice plates and the first splice plates being disposed on front and rear sides of the second side plates; each of the second connecting elements is connected to at least one of the second splice plates and at least one of the second side plates;

each of the second splice plates is detachably connected to two of the second connecting elements;

each of the second side plates is detachably connected to one of the first connecting elements and one of the second connecting elements;

wherein adjacent two of the first connecting elements are jointly connected to a corresponding one of the first side plates;

the first step body further comprises third splice plates detachably connected to the first connecting elements; adjacent two of the first connecting elements are jointly connected to a corresponding one of the third splice plates, and each of the third splice plates is disposed between corresponding two of the first splice plates;

adjacent two of the first connecting elements are jointly connected to a corresponding one of the third splice plates and corresponding two of the first splice plates, and the corresponding two of the first side plates and the corresponding one of the third splice plates are disposed side-by-side along a height direction of the splicing step device;

the second side plates and the second splice plates are assembled together through the second connecting elements to define one or more second accommodating cavities;

the second step body further comprises one or more second pedals; wherein the one or more second pedals are detachably connected to the second splice plates, the second side plates, and the second connecting elements; each of the second pedals covers on a corresponding second accommodating cavity; and a thickness of each of the second pedals is substantially equal to a height of each of the third splice plates.

* * * * *